US005928034A

United States Patent [19]

Tabata et al.

[11] Patent Number: 5,928,034

[45] Date of Patent: Jul. 27, 1999

[54] CONNECTOR WITH TERMINAL LOCKING AND LOCKING ASSURANCE FEATURES

[75] Inventors: Masaaki Tabata; Hajime Kawase; Junji Muta, all of Yokkaichi, Japan

[73] Assignee: Sumitomo Wiring Systems, Ltd., Japan

[21] Appl. No.: 08/902,187

[22] Filed: Jul. 29, 1997

[30] Foreign Application Priority Data

| | | | |
|---|---|---|---|
| Jul. 30, 1996 | [JP] | Japan | 8-200671 |
| Jul. 30, 1996 | [JP] | Japan | 8-200674 |
| Aug. 23, 1996 | [JP] | Japan | 8-222868 |

[51] Int. Cl.[6] ..... H01R 13/40

[52] U.S. Cl. ..... 439/595; 439/752.5

[58] Field of Search ..... 439/595, 744, 439/752.5

[56] References Cited

U.S. PATENT DOCUMENTS

| | | | |
|---|---|---|---|
| 3,218,599 | 11/1965 | Winkler | 439/744 |
| 5,529,515 | 6/1996 | Ohtaka et al. | 439/595 |

FOREIGN PATENT DOCUMENTS

| | | |
|---|---|---|
| 0 251 518 | 7/1988 | European Pat. Off. . |
| 0 389 955 | 3/1990 | European Pat. Off. . |
| 0 600 469 A1 | 12/1994 | European Pat. Off. . |
| 2 702 889 | 3/1994 | France . |

*Primary Examiner*—Steven L. Stephan
*Assistant Examiner*—Javaid Nasri
*Attorney, Agent, or Firm*—Anthony J. Casella; Gerald E. Hespos; Ludomir A. Budzyn

[57] ABSTRACT

A connector is provided to improve the reliability of a primary locking function by an elastic lock piece without deteriorating a secondary locking function and an insufficient insertion detecting function of a retainer. When female terminals (20) are properly inserted, a retainer (30) can be pushed to its fully fitted state or full lock position since elastic lock pieces (14) are not located in deformation permitting spaces (15). When there is/are insufficiently inserted terminal(s) (20), the retainer (30) cannot be pushed to its fully fitted state or full lock position since it comes into contact with the elastic lock pieces (14) in the spaces (15). Since a lock projection and the elastic lock piece (14) are locked outside the terminal (20), a large engaging space of the lock projection (23) with the elastic lock piece (14) can be ensured without restricting a projecting amount of the lock projections (23) by the internal construction of the terminals (20).

14 Claims, 15 Drawing Sheets

CONNECTOR WITH TERMINAL LOCKING AND LOCKING ASSURANCE FEATURES

BACKGROUND OF THE INVENTION

1. Field of the Invention

The present invention relates to a connector which holds inserted terminals using a retainer.

2. Description of the Prior Art

A known connector which holds inserted terminals using a retainer is shown in FIG. 26. This connector holds a terminal 2 in its proper insertion position by doubly locking it as follows. Primary locking is effected by fitting a projection 1A of an elastic lock piece 1 provided in a connector housing into a lock hole 2A of the terminal 2 and engaging it with the edge of the lock hole 2A. Secondary locking is effected by inserting a retainer 4 into a deformation permitting space 3 so as to prevent the displacement of the elastic lock piece 1 in such a direction to be disengaged from the terminal 2.

In this connector, when the terminal 2 is insufficiently inserted, the lower surface thereof comes into contact with the projection 1A, thereby pressing the elastic lock piece 1 down into the deformation permitting space 3. Thus, the retainer 4 cannot enter the deformation permitting space 3 due to contact of the retainer 4 with the downwardly deflected elastic lock piece 1. As a result, insufficient insertion of the terminal 2 can be detected.

In the above connector, the larger an engaging surface of the projection 1A with the lock hole 2A, i.e. the taller the projection 1A, the better a primary locking function by the elastic lock piece 1. However, in the case that a tongue 2B is provided immediately above the elastic lock piece 1 as shown in FIG. 26, the height of the projection 1A may be restricted by the tongue 2B. In such a case, the reliability of the primary locking function by the elastic lock piece 1 cannot be improved.

A known connector free from the above problem is shown in FIG. 27. In this connector, an elastic lock piece 5A having one end fixed and the other end hanging is formed by making a cut in a terminal 5 and bending this cut portion obliquely upward, and a connector housing 6 is formed with a projection 6A which can be locked with the elastic lock piece 5A. When the terminal 5 is inserted, the elastic lock piece 5A passes the projection 6A while undergoing an elastic deformation. When the terminal 5 is properly inserted, the elastic lock portion 5A is elastically restored to its original position to be locked with the projection 6A. Thus, the terminal 5 can be held in its proper insertion position. Since there is no strict restriction in increasing the projecting amount of the elastic lock piece 5A, the reliability of the primary locking function by the elastic lock piece 5A can be improved.

However, with this connector, it is difficult, due to a constructional reason, to secondarily lock the elastic lock piece 5A using a retainer. Therefore, the terminal 5 cannot be doubly locked using the retainer. Nor can the presence of the insufficiently inserted terminal 5 be detected.

The present invention was developed in view of the above problems and an object thereof is to provide a connector having an improved locking function.

SUMMARY OF THE INVENTION

According to the invention, there is provided a connector, comprising: a connector housing, at least one terminal insertable into the connector housing and holding means.

The holding means comprises at least one elastic lock piece provided on or in the connector housing so as to be engageable with or to interact with the terminal. A retainer is mountable on or in the connector housing so as to be engageable with the elastic lock piece. The elastic lock piece is being held engaged with the properly inserted terminal when the retainer is mounted in its holding position.

According to a preferred embodiment, the locking means further comprises a lock projection projecting from a surface of the terminal, in particular an outer surface thereof. The elastic lock piece is elastically displaced by the lock projection to project into a deformation permitting space when the terminal is insufficiently inserted and is elastically restored to or toward its original position when the terminal is properly inserted, thereby being locked with the lock projection to hold the terminal so as not to move in its withdrawal direction. Therefore a misplacement of the terminal(s) can be detected by verifying whether the lock projection(s) is/are arranged in the deformation permitting space, thereby improving the function of insufficient insertion detection of the terminal(s).

Preferably, at least one of the lock projection and the elastic lock piece is formed with a tapered slanted guide surface for guiding the elastic displacement or deformation of the elastic lock piece in a direction toward the deformation permitting space during the insertion of the terminal. Thus the insertion of the terminals is facilitated by allowing an easier displacement of the elastic lock piece into the deformation permitting space.

Further preferably, the retainer and/or the connector housing comprises a deformation preventing portion which prevents the elastic displacement or deformation of the elastic lock piece, preferably by entering a deformation permitting space, into which the elastic lock piece is deflected, and is hindered from entering the deformation permitting space by coming into contact with the elastically displaced elastic lock piece. Thus an improved locking is provided along with a function of detecting an insufficient insertion of the terminal(s).

According to a further preferred embodiment, there is provided a connector, comprising a connector housing into which at least one terminal is insertable. A retainer is mountable on the connector housing. A lock projection projects from an outer surface of the terminal. An elastic lock piece provided in the connector housing which is elastically displaced by the lock projection to project into a deformation permitting space when the terminal is insufficiently inserted and is elastically restored to its original position when the terminal is properly inserted, thereby being locked with the lock projection to hold the terminal so as not to move in its withdrawal direction. A deformation preventing portion is provided in the retainer and prevents the elastic displacement of the elastic lock piece by entering the deformation permitting space. However the deformation preventing portion is hindered from entering the deformation permitting space by contact with the elastically displaced elastic lock piece if the terminal is not fully inserted. At least one of the lock projection and the elastic lock piece is formed with a tapered or slanted guide surface for guiding the elastic displacement of the elastic lock piece in a direction toward the deformation permitting space during the insertion of the terminal.

Accordingly, when the lock projection causes the elastic lock piece to be elastically deformed during the insertion of the terminal, the elastic lock piece can smoothly undergo an elastic deformation because it is guided to the deformation permitting space by the slanted guide surface.

When the terminal is properly inserted, the lock projection and the elastic lock piece are engaged to effect additional locking or primary locking and the deformation preventing portion of the retainer prevents the elastic displacement of the elastic lock piece to effect holding or secondary locking. Thus, the terminal preferably is locked doubly. When the terminal is insufficiently inserted, the entrance of the deformation preventing portion into the deformation permitting space is hindered by coming into contact with the displaced elastic lock piece in the deformation permitting space. Accordingly, the insufficient insertion of the terminal can be detected.

Further, since the lock projection projects from the outer surface of the terminal and is locked with the elastic lock piece outside the terminal, a projecting amount of the lock projection can be set without being restricted by the internal construction of the terminal. Accordingly, a large engaging area of the elastic lock piece and the lock projection can be ensured, thereby improving the reliability of a primary locking function.

Thus, according to this preferred embodiment of the invention, the reliability of the additional or primary locking function by the elastic lock piece can be improved without deteriorating a holding or secondary locking function and an insufficient insertion detecting function of the retainer.

Preferably, at least one of the lock projection and the elastic lock piece is formed with a slanted guide surface for guiding the elastic displacement of the elastic lock piece in a direction toward the deformation permitting space during the withdrawal of the terminal.

Accordingly, in withdrawing the terminal, after the deformation preventing portion of the retainer is moved out of the deformation permitting space, the terminal is pulled in its withdrawal direction. Then, by being guided toward the deformation permitting space by the withdrawal guide surface, the elastic lock piece smoothly undergoes an elastic displacement to be disengaged from the lock projection. As a result, the terminal can be easily withdrawn.

Thus, according to this preferred embodiment of the invention, by providing the withdrawal guide surface, the elastic lock piece and the lock projection can be disengaged only by pulling the terminal. Therefore, it is not necessary to disengage the elastic lock piece from the lock portion using a jig and the terminal can be more easily withdrawn.

Further preferably, the elastic lock piece or portion has one end thereof fixed and the other end thereof hanging and preferably substantially extending along the insertion direction of the terminal (particularly in an undeformed state). The lock projection of the properly inserted terminal is lockable with the leading or hanging or deflectable or displaceable end of the elastic lock piece. An escape portion or means preferably is formed in an area of the elastic lock piece except its leading or hanging or deflectable end so that the lock projection moving according to the insertion of the terminal and the elastic lock piece do not interfere with each other.

Accordingly, since the lock projection moves within the escape portion without interfering the elastic lock piece during the insertion of the terminal, the elastic lock piece is not elastically deformed. Immediately before the terminal substantially reaches its proper insertion position, the lock projection engages the leading end of the elastic lock piece, causing the elastic lock piece to undergo an elastic deformation. When the terminal substantially reaches its proper insertion position immediately afterwards, the lock projection is disengaged from the elastic lock piece, then being elastically restored to its original position.

Since an insertion resistance due to the engagement of the lock projection and the elastic lock piece is only temporarily produced, only a small degree of operational resistance is produced as a whole and the insertion can be securely performed because an operator can know a final stage of the insertion by sensing the temporary insertion resistance. Further, since the lock projection engages not the base end of the elastic lock piece, but the leading end thereof, a stress produced in the elastic lock piece can be reduced.

Still further preferably, the width of the elastic lock piece is set substantially larger than that of the terminal.

Accordingly, the elastic lock piece needs not enter the inside of the female terminal. Such a construction enhances the strength of the elastic lock piece against deformation, thereby improving the primary locking function by the elastic lock piece. Further, even if the deformation preventing portion comes into contact with the elastic lock piece deformed to project into the deformation permitting space with a large force, the elastic lock piece is unlikely to be deformed.

Still further preferably, the retainer is provided with an excessive deformation preventing portion which prevents the elastic lock piece from being elastically deformed to a larger extent than specified, preferably by entering the deformation permitting space when the retainer is not in its holding position, the retainer being preferably in its partially fitted state or partial lock position.

Most preferably, the retainer is provided with an excessive deformation preventing portion which enters the deformation permitting space when the retainer is in its partially fitted state or partial lock position to prevent the elastic lock piece from being elastically deformed to a larger extent than specified.

Accordingly, if the elastic lock piece is deformed to a larger extent than specified when being deformed to project into the deformation permitting space during the insertion or withdrawal of the terminal, any further deformation is prevented by the excessive deformation preventing portion. This prevents the elastic lock piece from being excessively deformed beyond its elasticity limit.

According to a further preferred embodiment, at least either one of the terminal and an engaging portion of the elastic lock piece is formed with a slanted terminal guide surface for pushing the terminal in an insufficient insertion position to its proper insertion position as the elastic lock piece is deformed according to the displacement of the retainer to its holding position.

Thus, according to this embodiment of the invention, there is provided a connector, comprising a connector housing, at least one terminal insertable into the connector housing, and an elastic lock piece provided on the connector housing so as to be engageable with the terminal. A retainer mountable on the connector housing so as to be engageable with the elastic lock piece. The elastic lock piece is held engaged with the properly inserted terminal when the retainer is mounted in its holding position. At least one of the terminal and an engaging portion of the elastic lock piece is formed with a slanted terminal guide surface for pushing the terminal in an insufficient insertion position to its proper insertion position as the elastic lock piece is deformed according to the displacement of the retainer to its holding position.

Accordingly, as the retainer is displaced to the holding position with the terminal insufficiently inserted, the elastic lock piece is deformed and the slanted terminal guide surface pushes the terminal to its proper insertion position.

Accordingly, even if the terminal is insufficiently inserted, it needs not be inserted again.

Preferably, a displacement direction of the retainer to its holding position is substantially parallel with an insertion direction of the terminal, and at least either one of the retainer and an engaging portion of the elastic piece is formed with a slanted lock piece guide surface for causing the deformation of the elastic lock piece in such a direction to push the terminal in the insufficient insertion position to its proper insertion position as the retainer is displaced to its holding position.

Accordingly, as the retainer is displaced to the holding position with the terminal insufficiently inserted, the lock piece guide surface causes the deformation of the elastic lock piece. As the elastic lock piece is deformed, the terminal guide surface pushes the terminal from the insufficient insertion position to its proper insertion position. Since the retainer can be mounted from front with respect to the connector housing, even if the connector housing is surrounded by a hood, the retainer can be easily mounted.

According to still a further preferred embodiment, the connector further comprises additional locking means for holding the terminal in its properly inserted state(s) provided additionally to the holding means. Thus there is preferably provided a connector, comprising a connector housing into which at least one terminal is insertable. An additional or first locking means is provided for holding the terminal in its properly inserted state. A holding means or second locking means additionally is provided in a position different from the first locking means for holding the terminal in its properly inserted states. The second locking means comprises: an elastic lock piece provided in the connector housing. A lock portion is provided on or in the terminal for holding the terminal in its properly inserted state by being locked with the elastic lock piece and for, when the terminal is insufficiently inserted, interfering with the elastic lock piece so as to elastically deform the elastic lock piece. A retainer is provided for holding the elastic lock piece and the lock portion locked when the terminal is properly inserted and for interfering with the elastically deformed elastic lock piece when the terminal is insufficiently inserted.

Accordingly, when the terminal is properly inserted, the additional or first locking means holds the terminal in such a manner that the terminal cannot be withdrawn. On the other hand, in the holding means or second locking means, the elastic lock piece and the lock portion are locked to hold the terminal and the retainer holds the elastic lock piece and the lock portion locked. Thus, the terminal is doubly locked by the first and second locking means provided in different positions. Further, if the terminal is insufficiently inserted, the retainer interferes the elastically deformed elastic lock piece. Accordingly, it can be known that the terminal is insufficiently inserted.

As described above, this embodiment of the invention further improves the reliability of a function of holding the terminal in its properly inserted state while keeping a function of detecting the insufficient insertion of the terminal.

Preferably, the terminal has two outer surfaces which are arranged at an angle different from 0° or 180°, preferably substantially perpendicular to each other when viewed from front, and the holding meas and the additional locking means are arranged on one and the other of the two outer surfaces, respectively.

Accordingly, even if one of the outer surfaces of the terminal which are perpendicular to each other is displaced toward or away from the inner wall surface of the connector housing, there is no likelihood that the other outer surface is displaced toward or away from the inner wall surface of the connector housing. Accordingly, even if the locked state of the locking means changes as the outer surface of the terminal is displaced toward or away from the inner wall surface of the connector housing, this locking means does not influence the locked state of the other locking means, thereby enhancing the reliability of the double locking function.

Further preferably, a slanted guide portion for deforming the elastic lock piece in such a direction to be disengaged from the lock portion as the terminal is withdrawn is provided on at least one of the elastic lock piece and the lock portion.

Accordingly, when the terminal is to be withdrawn, the holding of the terminal by the first locking means is released, and the retainer as the second locking means is detached to release the locked state of the elastic lock piece and the lock portion. In this state, the terminal is pulled. Then, the elastic lock piece is deformed in such a direction to be disengaged from the lock portion by the guide portion, thereby releasing the holding of the terminal by the second locking means. Accordingly, the terminal can be easily withdrawn. This connector has a better operability because the second locking means needs not be unlocked using a jig in withdrawing the terminal.

These and other objects, features and advantages of the present invention will become more apparent upon a reading of the following detailed description and accompanying drawings.

DETAILED DESCRIPTION OF THE PREFERRED EMBODIMENT

Figure 1:
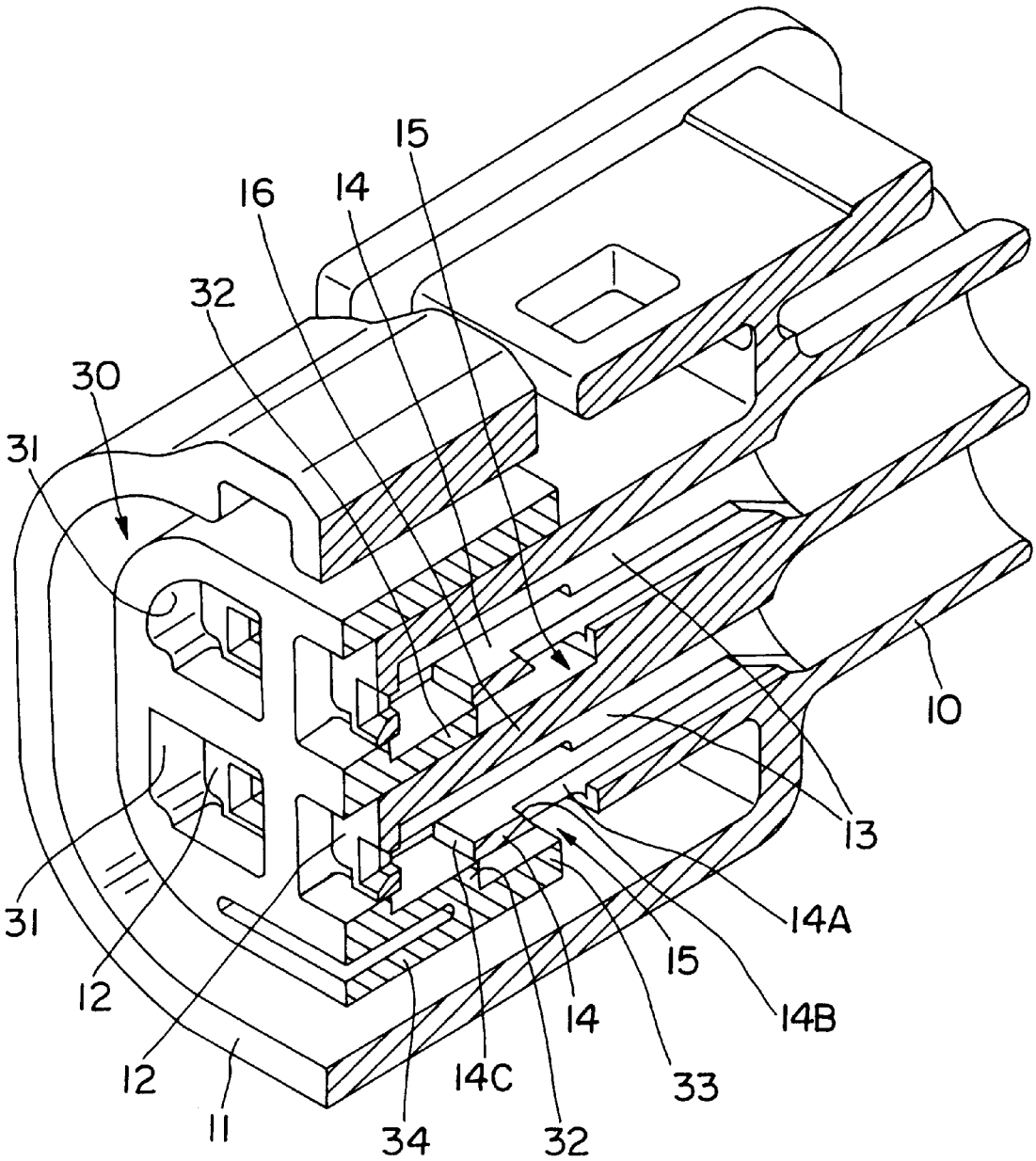
FIG. 1 is a perspective view partly in section of a first embodiment of the invention.
Figure 2:
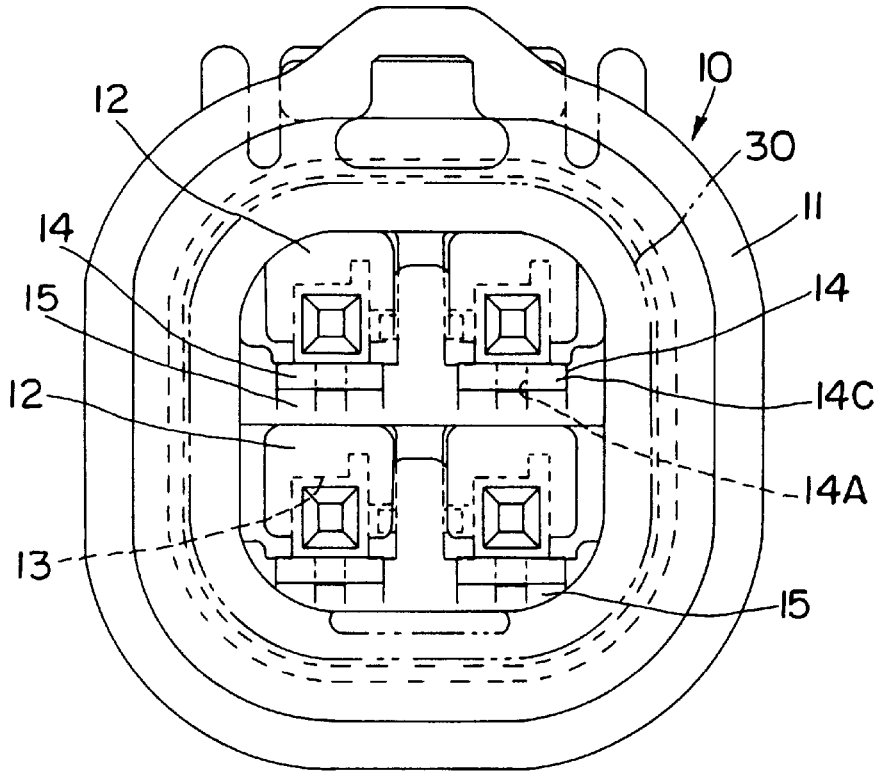
FIG. 2 is a front view of the first embodiment.

With reference to FIGS. 1 to 8, a connector according to a first embodiment is comprised of a connector housing 10 into which female terminals 20 are inserted, and a retainer 30 to be mounted on the connector housing 10 to hold the female terminals 20 in their inserted states.

Each female terminal 20 is comprised of a preferably substantially rectangular, tubular portion 21 and a wire fixing portion 22 which are integrally or unitarily and substantially continuously formed one after the other. The tubular portion 21 is formed with a lock projection 23 preferably by embossing the lower surface thereof. This lock projection 23 has preferably a shape of an isosceles trapezoid when viewed sideways. The front surface of the lock projection 23 is a slanted insertion guide surface 23A which extends in a first direction and obliquely downwardly in FIGS. 1–8. The rear surface thereof is a slanted withdrawal guide surface 23B which is extending in the first direction and obliquely downwardly in FIGS. 1–8.

In the connector housing 10, there are provided a plurality of blocks 12 arranged in rows at upper and lower stages within a hood 11. In this embodiment, four blocks 12 are arranged with two blocks in each row at the upper and lower stages in the hood 11. The female terminals 20 are inserted into cavities 13 formed in the respective blocks 12 through openings preferably at the back of the cavities 13.

An opening is formed in a surface, preferably the lower surface, of a front end portion of each cavity 13 at the upper stage, i.e. in a partition wall with the lower blocks 12. An opening is also formed in the lower surface of a front end portion of each cavity 13 at the lower stage, i.e. in the lower surface of the connector housing.

Elastic lock pieces 14 preferably are provided in or at the openings of the respective cavities 13. Each elastic lock piece 14 extends forwardly substantially in parallel with an insertion direction A of the female terminal 20 with one end fixed at the rear edge of the opening and the other end free or deformable or hanging. The elastic lock piece 14 is preferably platelike with its substantially planar surface extending in substantially horizontal direction and is elastically deformable along the first direction which is a direction substantially transverse to the insertion direction A. The deflection preferably is downwardly relative to the orientation shown in FIGS. 1–8.

In the substantially middle of the elastic lock piece 14 with respect to its widthwise direction, an escape groove 14A (a recess) is formed to extend along forward and backward directions in parallel with the insertion direction of the female terminal 20. The escape groove 14A extends from the base end (rear end) of the elastic lock piece 14 to a front position thereof, preferably immediately behind the front end of the elastic lock piece 14. A lock projection 23 enters the escape groove 14A while the female terminal 20 is being inserted and withdrawn. The lock projection 23 does not deflect the elastic lock piece 24 and is preferably not in contact with the elastic lock piece 14 while being located in the escape groove 14A. The inner surface of the front end of the escape groove 14A acts as a slanted insertion guide surface 14B which extends obliquely upward. The front end of the elastic lock piece 14 is a substantially vertically extending locking surface 14C.

As described above, since the elastic lock piece 14 engages the lock projection 23 outside the female terminal 20 without entering the inside thereof, the width of the elastic lock piece 14 can be set without being restricted by the width of the female terminal 20. Accordingly, in this embodiment, the width of the elastic lock piece 14 is set larger than the width of the tubular portion 21 of the female terminal 20.

As described above, the elastic lock pieces 14 are elastically deformable in a direction at an angle different from 0° or 1800° to the insertion direction A, e.g. downwardly, and deformation permitting spaces 15 are provided in the deformation direction of the lock piece 14, e.g. below the respective elastic lock pieces 14. Upon deformation, the elastic lock pieces 14 are angled or slanted with the front ends lowered, thereby projecting into the deformation permitting spaces 15. Deformation preventing portions 32 of the retainer 30 to be described later can also enter the deformation permitting spaces 15.

The retainer 30 is mounted on the connector housing 10 from front, and defines a second locking means together with the lock projections 23, and preferably the withdrawal guide surfaces 23B and the elastic lock pieces 14. Four mount holes 31 which are preferably through holes extending along forward and backward directions are formed in the retainer 30. When the retainer 30 is mounted on the connector housing 10, it substantially covers the outer surface of the connector housing 10 and the blocks 12 are fitted in the respective mount holes 31. The retainer 30 is selectively held on the connector housing 10 in a partially fitted state or partial lock position and a fully fitted state or full lock position by an unillustrated locking means. When the retainer 30 is partly locked, the front end surface of the retainer 30 is substantially in flush with the front end of the hood 11 (see FIG. 4). When the retainer 30 is fully locked, the front end surface of the retainer 30 is located in a position more backward than the front end surface of the hood 11 (see FIG. 5).

Figure 5:
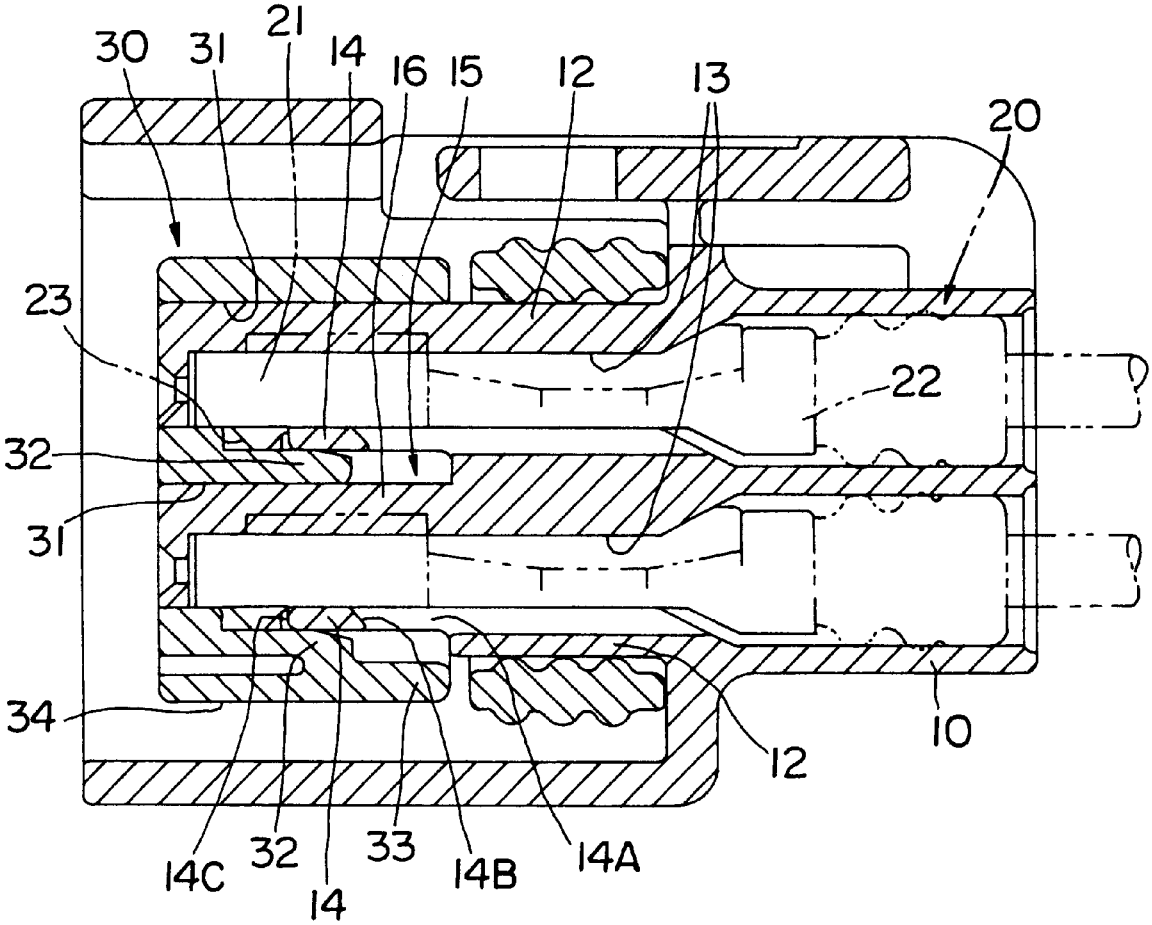
FIG. 5 is a vertical section of the first embodiment when terminals are properly inserted and the retainer is fully locked.

The deformation preventing portions 32 are provided in the respective mount holes 31. The deformation preventing portions 32 of the two mount holes 31 at the upper stage are formed by a partition wall partitioning the mount holes 31 at the upper and lower stages, whereas those of the two mount holes 31 at the lower stage are formed by slightly raising the lower surface of the mount holes 31. With the retainer 30 partly locked, the deformation preventing portions 32 are located before the front ends of the elastic lock pieces 14, and the elastic lock pieces 14 are permitted to be elastically deformed to project into the deformation permitting spaces 15, FIG. 7. When the retainer 30 is fully locked, the deformation preventing portions 32 enter the deformation permitting spaces 15, and under the elastic lock pieces 14. Thus the elastic deformation of the elastic lock pieces 14 is prevented as shown in FIG. 5. When the deformed elastic lock pieces 14 project into the spaces 15, the front ends thereof abut against the deformation preventing portions 32, and a movement of the retainer 30 from its partially fitted state or partial lock position to its fully fitted state or full lock position is prevented.

Portions of a bottom wall 34 of the retainer 30 projecting more than the deformation preventing portions 32 are excessive deformation preventing portions 33 corresponding to the elastic lock pieces 14 at the lower stage. These excessive deformation preventing portions 33 enter the deformation permitting spaces 15 when the retainer 30 is in its partially fitted state or partial lock position, and are located below the elastic lock pieces 14.

For the elastic lock pieces 14 at the upper stage, the upper walls of the blocks 12 of the lower stage of the connector housing 10 act as excessive deformation preventing portions 16. These excessive deformation preventing portions 16 are located below the elastic lock pieces 14 when the deformation preventing portions 32 are retracted forwardly from the deformation permitting spaces 15 upon partial locking of the retainer 30.

Figure 3:
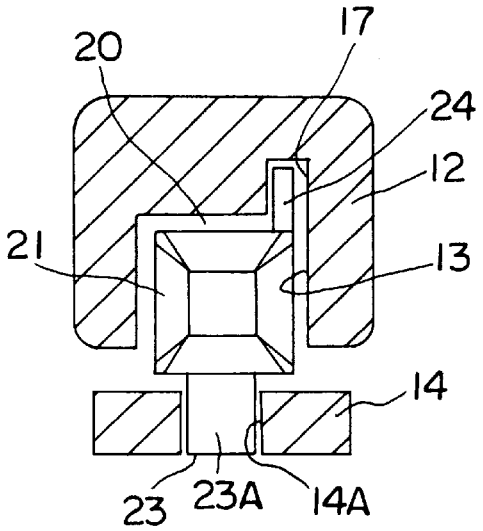
FIG. 3 is an enlarged partial horizontal section showing a locked state of a lock projection and an elastic lock piece in the first embodiment.

Preferably the terminal 20 may be provided with a guide projection 24 and the connector housing 10 may be provided with a corresponding guide recess 17, as shown in FIG. 3. By the engagement or fitting of the guide projection into the guide recess 17 the insertion of the terminal 20 into the connector 10 is guided and sticking or wedging or lateral deflection of the terminal 20 is avoided, thus enhancing the operability of the connector as a whole.

Next, the action of this embodiment is described.

Figure 4:
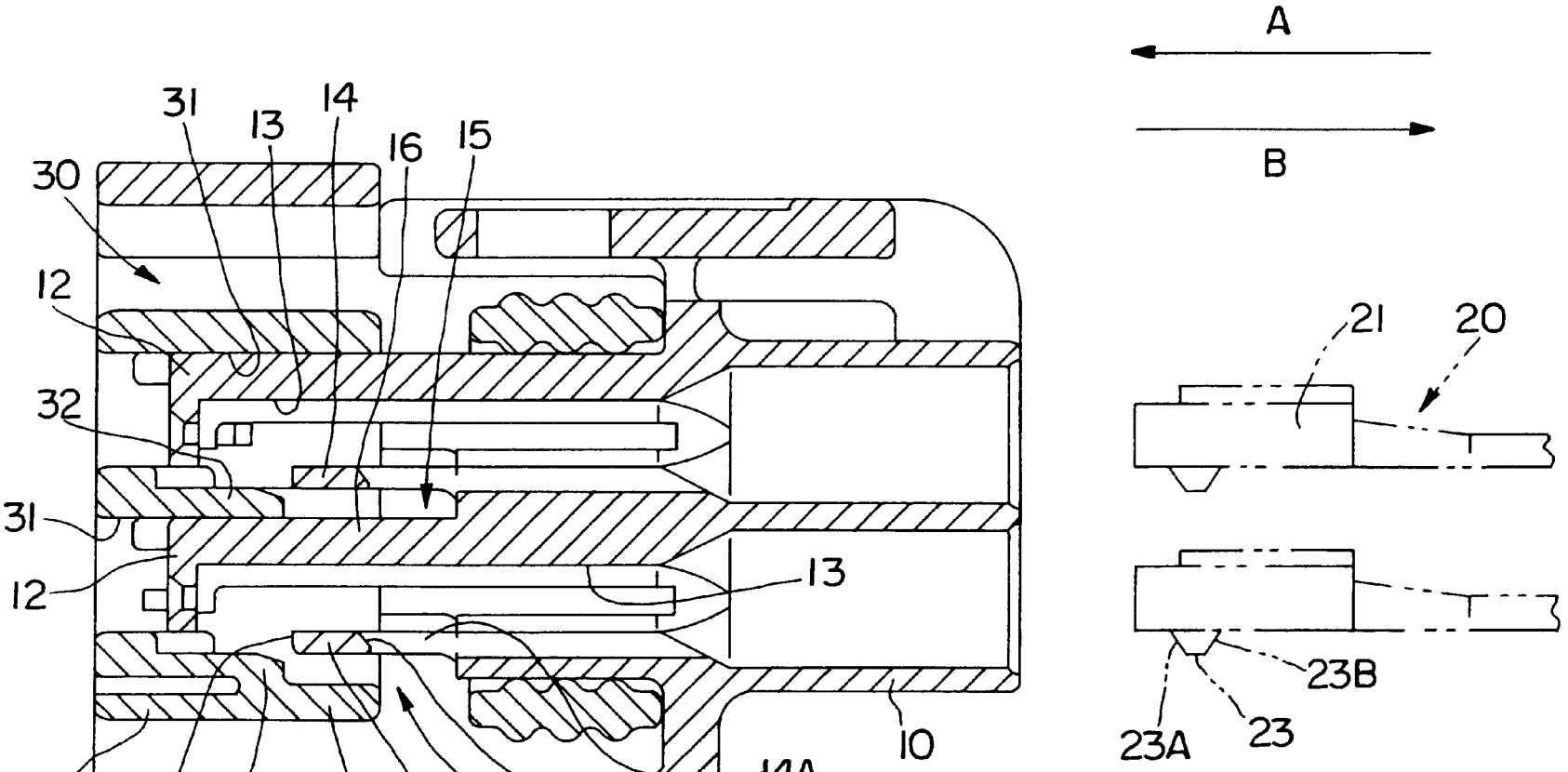
FIG. 4 is a vertical section of the first embodiment when a retainer is partly locked.

In assembling the connector according to this embodiment, first, the retainer 30 is partly locked with the connector housing 10 through the opening in the front surface of the hood 11. In this state, since the deformation preventing portions 32 are located at a distance or spaced or before the elastic lock pieces 14 as shown in FIG. 4, the elastic lock pieces 14 are permitted to be elastically deformed to project into the deformation permitting spaces 15.

In this partly fitted or locked state, when the female terminals 20 are inserted into the cavities 13, they are moved with their bottom surfaces preferably in sliding contact with the upper surfaces of the elastic lock pieces 14. Further, from an intermediate stage of the insertion, the lock projections 23 enter the escape grooves 14A of the elastic lock pieces 14 and, accordingly, move without interfering the elastic lock pieces 14.

Figure 6:
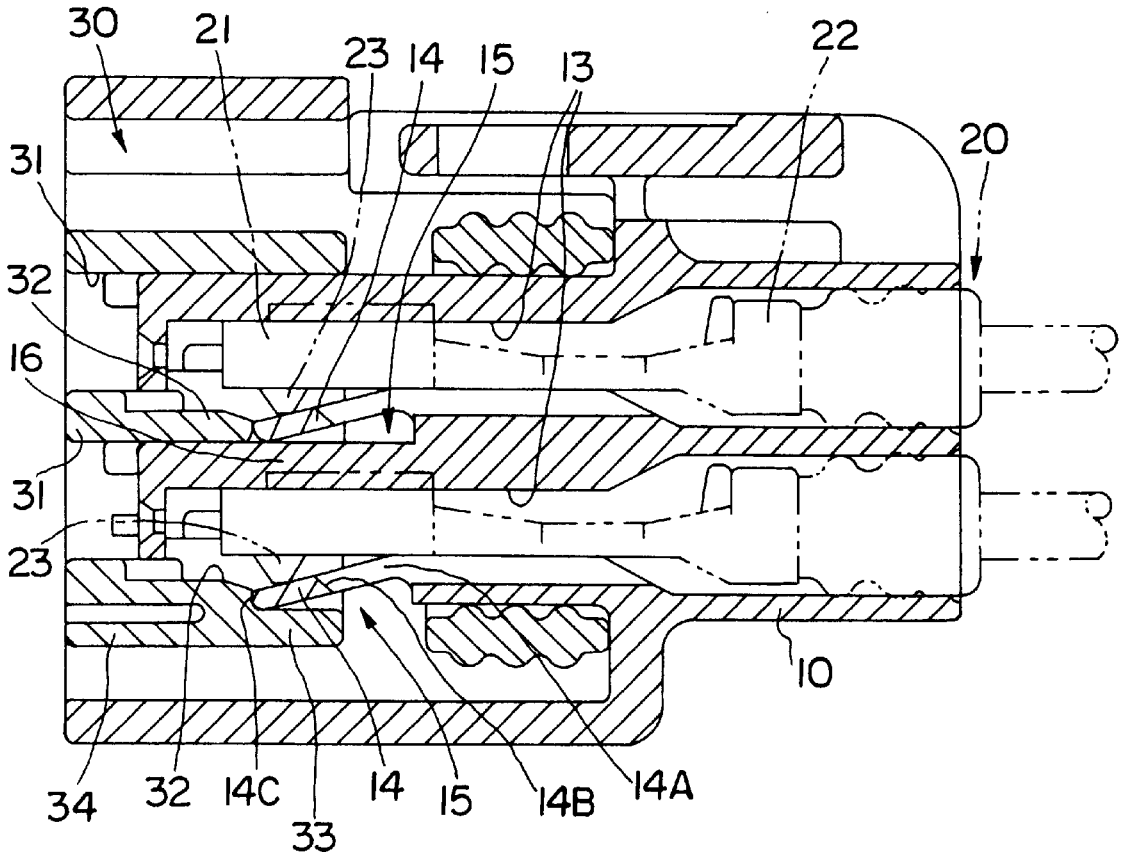
FIG. 6 is a vertical section of the first embodiment when the terminals are insufficiently inserted.
Figure 7:
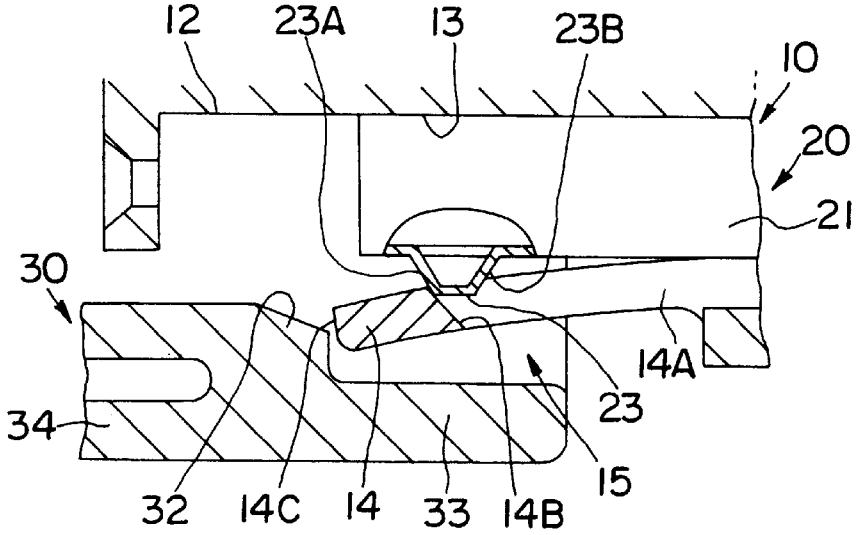
FIG. 7 is an enlarged partial vertical section showing a locked state of the lock projection and the elastic lock piece during the insertion of the terminal in the first embodiment.

When the female terminals 20 approach their proper insertion positions, the insertion guide surfaces 23A of the lock projections 23 come into contact with the insertion guide surfaces 14B at the front ends of the escape grooves 14A. Then, a pressing force acts in a direction at an angle different from 0° or 180°, preferably substantially transversely to the insertion direction A, in particular downwardly, on the front ends of the elastic lock pieces 14 due to the inclination of the insertion guide surfaces 14B, 23A, with the result that the elastic lock pieces 14 are elastically deformed to project into the deformation permitting spaces 15 as shown in FIG. 7. Thereafter, as shown in FIG. 6, the lock projections 23 move further forward while being in sliding contact with the front ends of the elastic lock pieces or portions 14.

When the female terminals 20 reach their proper insertion positions, the lock projections 23 are disengaged from the front ends of the elastic lock pieces 14, which are in turn elastically restored to their original positions, moving away from the deformation permitting spaces 15. As a result, the front end surfaces of the elastic lock pieces 14 engage the lock projections 23 from behind as shown in FIG. 5, effecting additional or primary locking.

Thereafter, when the retainer 30 is pushed from its partially fitted state or partial lock position to its fully fitted state or full lock position, the deformation preventing portions 32 enter the deformation permitting spaces 15 and slip or are inserted under the elastic lock pieces 14 as shown in FIG. 5 i.e. being arranged between the elastic lock pieces 14 and the wall portion of the connector housing defining at least partially the cavity 13, thereby preventing the elastic lock pieces 14 from being elastically deformed in such a direction to be disengaged from the lock projections 23. In this way, holding or main locking or secondary locking is effected. Thus, the female terminals 20 are doubly locked and securely held in their proper insertion posit ions while their movements in their withdrawal direction are prevented.

In the case that not all female terminals 20 have reached their proper insertion positions, i.e. there is/are insufficiently inserted female terminals 20, the following occurs.

When the female terminal 20 is insufficiently inserted, as shown in FIG. 6, the lock projection 23 is engaged with the upper surface of the front end portion of the elastic lock piece 14, causing the elastic lock piece 14 to be elastically deformed and project into the deformation permitting space 15. Accordingly, even if an attempt is made to push the retainer 30 to its fully fitted state or full lock position, the deformation preventing portion 32 cannot enter the space 15 because the leading end of the deformation preventing portion 32 abuts against the leading end of the elastic lock piece 14.

Figure 8:
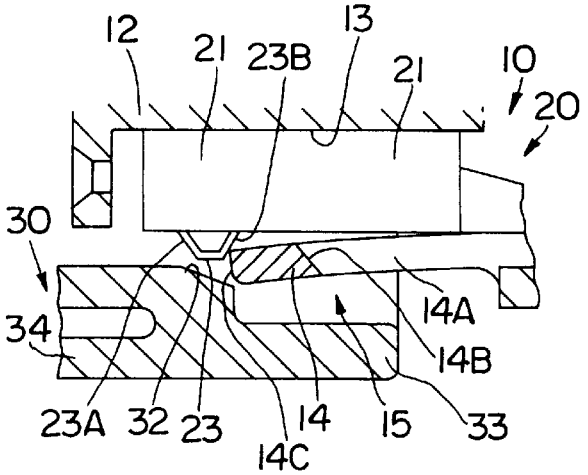
FIG. 8 is an enlarged partial vertical section showing a locked state of the lock projection and the elastic lock piece during the withdrawal of the terminal in the first embodiment.

In order to withdraw the female terminals 20, the retainer 30 is first pulled back from its fully fitted state or full lock position to its partially fitted state or partial lock position. Then, the deformation preventing portions 32 are disengaged from the elastic lock pieces 14, thereby releasing the secondary locking. Further, the deformation preventing portions 32 are moved out of the deformation permitting spaces 15, thereby enabling the elastic deformation of the elastic lock pieces 14. If the terminals 20 are pulled in withdrawal direction in this state, the withdrawal guide surfaces 23B of the lock projections 23 engage the front edges of the elastic lock pieces 14 as shown in FIG. 8. The elastic lock pieces 14 smoothly undergo an elastic deformation by being guided downward by the inclination of the withdrawal guide surfaces 23B, thereby releasing the primary locking by the lock projections 23 and the elastic lock pieces 14.

After the lock projections 23 slide along the upper surfaces of the front end portions of the elastic lock pieces 14 as shown in FIG. 6, the elastic lock pieces 14 are elastically restored to their original positions and the lock projections 23 enter the escape grooves 14A and move out of contact with the elastic lock pieces 14. Finally, the female terminals 20 are withdrawn from the cavities 13.

As described above, in this embodiment, each female terminal 20 is doubly locked by primary locking of the lock projection 23 of the female terminal 20 and the elastic lock piece 14 and by secondary locking of the elastic piece 14 and the deformation preventing portion 32 of the retainer 30.

Further, since the retainer 30 can be moved to its fully fitted state or full lock position when all female terminals 20 are properly inserted and cannot be moved to its fully fitted state or full lock position when there is/are insufficiently inserted female terminal(s) 20 , the insufficient insertion of the female terminals 20 can be detected based on whether or not the retainer 30 can be pushed to its fully fitted state or full lock position.

Furthermore, since the lock projection 23 projects from the outer surface of the female terminal 20 and the primary locking thereof with the elastic lock piece 14 is effected outside the female terminal 20, a projecting amount of the lock projection 23 can be increased without being restricted by the internal construction of the female terminal 20. Accordingly, an engaging area of the lock projection 23 with the elastic lock piece 14 can be made larger by increasing the projecting amount of the lock projection 23, thereby improving the reliability of the primary locking by the elastic lock piece 14.

In other words, according to this embodiment, the reliability of a primary locking function by the elastic lock piece 14 can be improved without deteriorating a secondary locking function and an insufficient insertion detecting function of the retainer 30.

Likewise, in this embodiment, the slanted insertion guide surfaces 14B, 23A are formed on the elastic lock pieces 14 and the lock projections 23, respectively so as to smooth the elastic deformation of the elastic lock pieces 14. Accordingly, it is not necessary to disengage the elastic lock pieces 14 from the lock projection 23 using jigs and the female terminals 20 can be more easily inserted.

Further, since the escape grooves 14A are formed in the elastic lock pieces 14, the lock projections 23 and the elastic lock pieces 14 do not interfere with each other during most of the insertion of the female terminals 20, and the lock projections 23 engage the elastic lock pieces 14 only immediately before the female terminals 20 reach their proper insertion positions. Accordingly, only a small degree of resistance acts during the insertion, improving an operability. Further, since an insertion resistance temporarily becomes larger immediately before the female terminals 20 reach their proper insertion positions, a final stage of the insertion can be known to an operator, thereby preventing him from finishing the operation with the female terminals 20 insufficiently inserted. Furthermore, since the lock projection 23 engages not the base end of the elastic lock piece 14, but the front end thereof, a stress which acts on the elastic lock piece 14 can be reduced.

Further, in this embodiment, the width of the elastic lock piece 14 is set larger than that of the female terminal 20 in view of a constructional feature: the elastic lock piece 14 needs not enter the inside of the female terminal 20. Such a construction enhances the strength of the elastic lock piece against deformation, thereby improving the primary locking function by the elastic lock piece 14. Further, even if the deformation preventing portion 32 comes into contact with the elastic lock piece 14 deformed to project into the deformation permitting space 15 with a large force, the deformation of the elastic lock piece 14 can be securely prevented.

Furthermore, in this embodiment, while the retainer 30 is in its partially fitted state or partial lock position, the excessive deformation preventing portions 16, 33 are located below the elastic lock pieces 14. Accordingly, when the elastic lock pieces 14 are deformed by the engagement with the lock projections 23 during the insertion and withdrawal of the female terminals 20 and/or when a force substantially transverse to the insertion direction A, in particular a downward force acts on the leading ends of the elastic lock pieces 14 by the elastic lock pieces 14 being brought into contact with the deformation preventing portions 32 during the insufficient insertion detection, the elastic lock pieces 14 come into contact with the excessive deformation preventing portions 16, 33. As a result, an excessive deformation of the elastic lock pieces 14 beyond its elasticity limit can be prevented and a stress which acts on the elastic lock pieces 14 can be suppressed.

Figure 9:
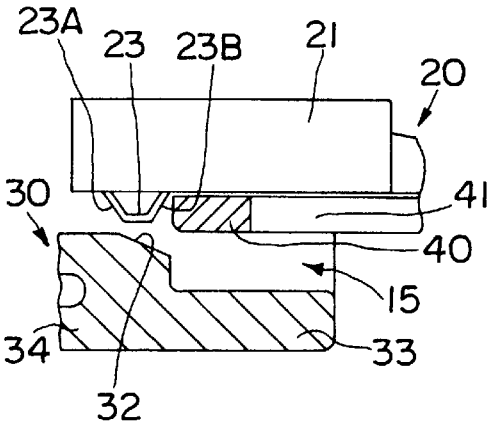
FIG. 9 is an enlarged partial vertical section showing a lock projection and an elastic lock piece according to a second embodiment.

A second embodiment, as illustrated in FIG. 9, differs from the first embodiment in the construction of the elastic lock piece. More particularly, an elastic lock piece 40 according to the second embodiment is shaped similar to that of the first embodiment as a whole. However, an inner wall surface of the front end of an escape groove 41 extends in a direction substantially perpendicular to the insertion direction of the female terminal 20. When the female terminal 20 is inserted, the elastic lock piece 40 is smoothly elastically deformed by the insertion guide surface 23A of the lock projection 23 engaging the upper edge of the inner wall surface of the front end of the escape groove 41.

Figure 10:
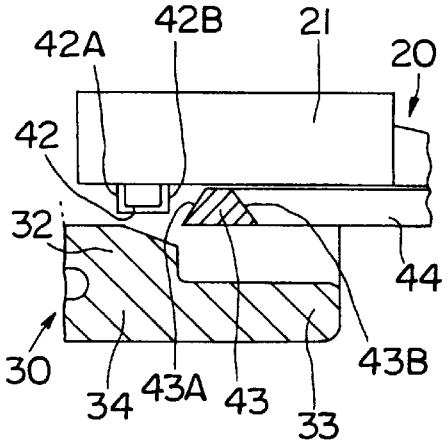
FIG. 10 is an enlarged partial vertical section showing a lock projection and an elastic lock piece according to a third embodiment.

A third embodiment, as illustrated in FIG. 10, differs from the first embodiment in the construction of the elastic lock piece. More particularly, a lock projection 42 according to the third embodiment is formed e.g. by embossing as in the first embodiment and has a rectangular shape when viewed side ways. Specifically, front and rear surfaces 42A, 42B extend in a direction perpendicular to the insertion direction of the female terminal 20. An elastic lock piece 43 basically has the same construction as that of the first embodiment except that its front end surface acts as a slanted withdrawal guide surface 43A which is inclined obliquely upward. An inner wall surface of the front end of an escape groove 44 acts as a slanted guide surface 43B which is inclined obliquely upward. During the withdrawal of the female terminal 20, the elastic lock piece 43 is smoothly elastically deformed by the lock projection 42 engaging the withdrawal guide surface 43A.

Figure 11:
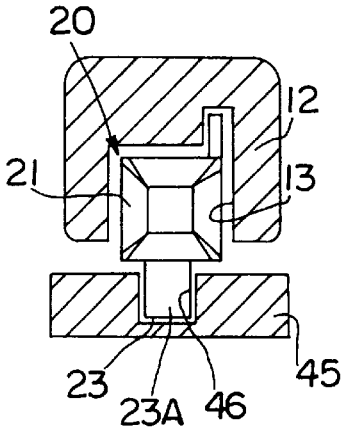
FIG. 11 is an enlarged partial horizontal section showing a locked state of a lock projection and an elastic lock piece according to a fourth embodiment.

A fourth embodiment of the invention, as shown in FIG. 11, differs from the first embodiment in the construction of the elastic lock piece. According to the fourth embodiment, an elastic lock piece 45 is thicker than that of the first embodiment, and an escape groove 46 is so formed as to be open in the upper surface thereof, but not in the lower surface thereof. Since such a thick elastic lock piece 45 has high strength against deformation, the reliability of primary locking can be improved.

Figure 12:
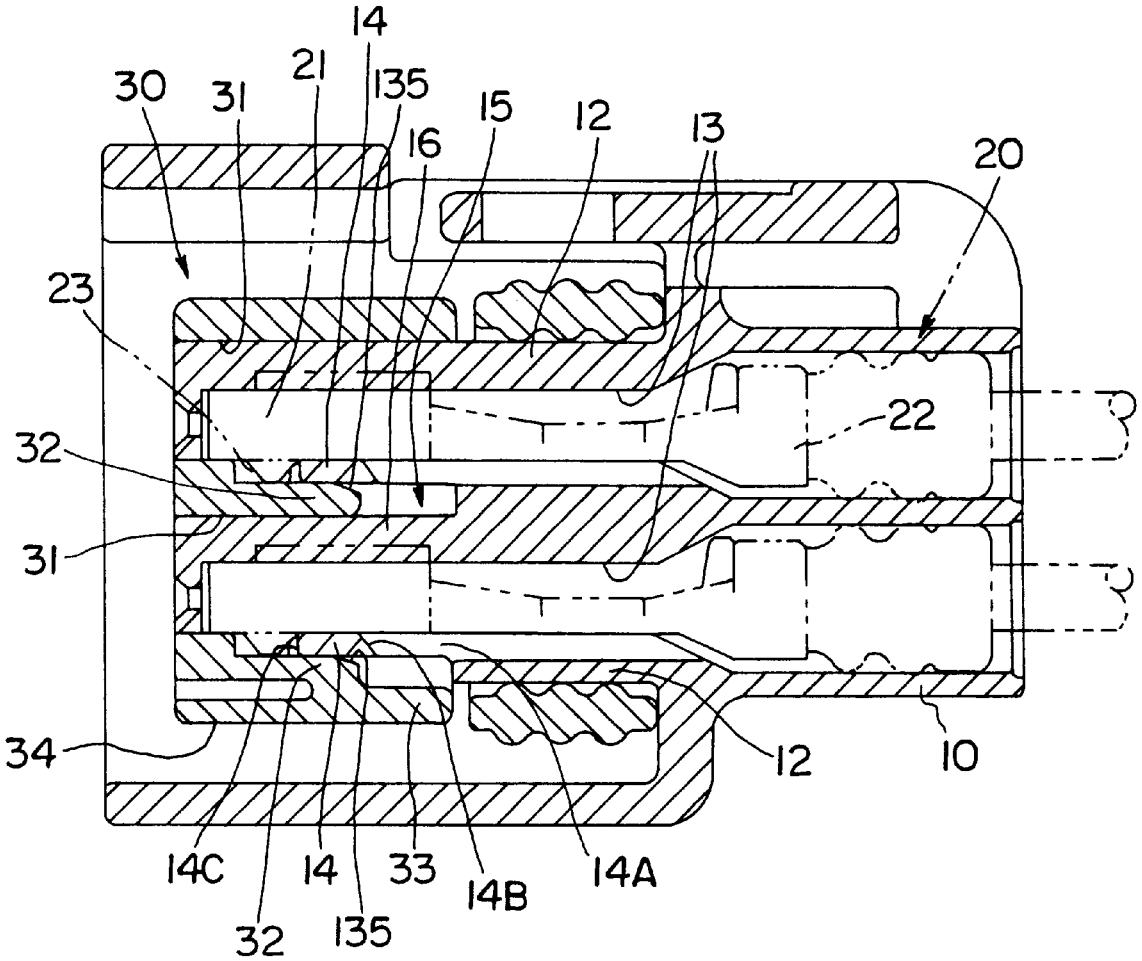
FIG. 12 is a vertical section of the fifth embodiment when the terminals are properly inserted.
Figure 13:
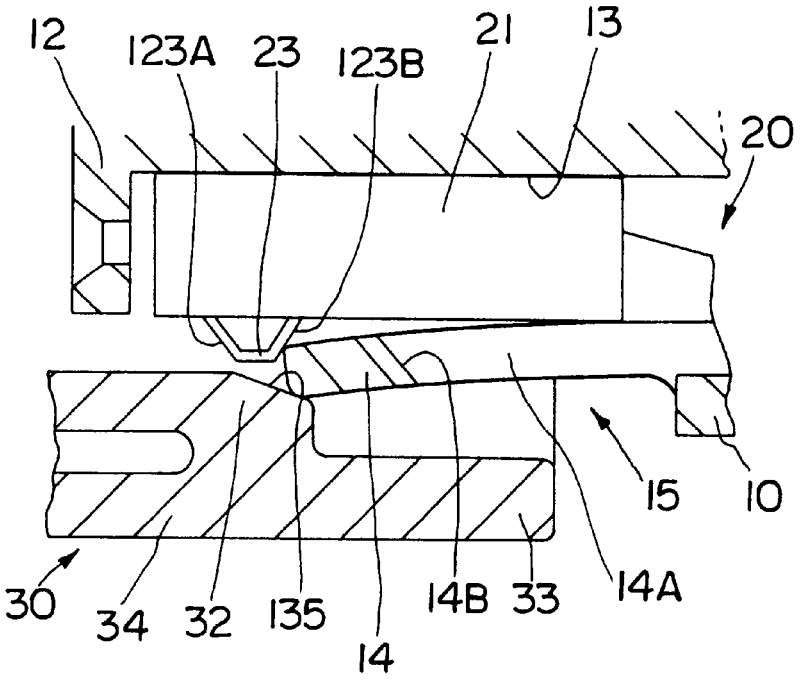
FIG. 13 is an enlarged partial vertical section of the fifth embodiment when the terminal is pushed from an insufficient insertion position to a proper insertion position.

A fifth embodiment of the invention is described with reference to FIGS. 12 and 13. A connector housing according to this embodiment is comprised of a connector housing 10 into which female terminals 20 are inserted, and a retainer 30 to be mounted on the connector housing 10 in order to hold the female terminals 20 in their inserted states.

Each female terminal 20 is comprised of a preferably substantially rectangular tubular portion 21 and a wire fixing portion 22 which are integrally and continuously formed one after the other. The tubular portion 21 is formed with a lock projection 23 by embossing the lower surface thereof. This lock projection 23 preferably has a shape of an isosceles trapezoid when viewed sideways. The front surface of the lock projection 23 is a slanted terminal guide surface 123A which extends at an angle different from 0° or 180° with respect to an insertion direction of the terminal(s) 20, in particular substantially obliquely downward. The rear surface thereof is a slanted terminal guide surface 123B which extends at an angle different from 0° or 180° with respect to the insertion direction of the terminal(s) 20, in particular substantially obliquely downward. The terminal guide surface 123B has a function of pressing the female terminal 20 in an insufficient insertion position to a proper insertion position and a function of improving an operability during the withdrawal of the female terminal 20.

The retainer 30 is mounted on the connector housing 10 from front, and defines a second locking means together with the lock projections 23, the terminal guide surfaces 124B and the elastic lock pieces 14. In the illustrated embodiment, four mount holes 31, which are preferably through holes extending along forward and backward directions, are formed in the retainer 30. When the retainer 30 is mounted on the connector housing 10, it covers the outer surface of the connector housing 10 and the blocks 12 are fitted in the respective mount holes 31. The retainer 30 is selectively held on the connector housing 10 in a partial lock position and a full lock position (holding position) by an unillustrated locking means. When the retainer 30 is partly locked, the front end surface of the retainer 30 is substantially in flush with the front end of the hood 11. When the retainer 30 is fully locked, the front end surface of the retainer 30 is located in a position more backward than the front end surface of the hood 11 (see FIG. 12).

The deformation preventing portion 32 is substantially similar to that of the first embodiment, and may be additionally formed with a lock piece guide surface 135 used to push the insufficiently inserted female terminal 20 to its proper insertion position. This guide surface 135 extends from a substantially middle position of the deformation preventing portion 32 with respect to forward and backward directions to the rear end edge (right end edge in FIGS. 12 and 13) thereof, and is moderately inclined at an angle different from 0° or 180° with respect to the insertion direction A of the terminal 20, e.g. obliquely downward to the back. If the elastic lock piece 14 is deformed to a relatively small extent by the engagement of the terminal guide surface 123B of the lock projection 23 and the upper edge of the leading end of the elastic lock piece 14 with the female terminal 20 insufficiently inserted, the lower edge of the leading end of the elastic lock piece 14 engages the lock piece guide surface 135 when the retainer 30 is displaced from its partial lock position to its full lock position. On the other hand, if the elastic lock piece 14 is deformed to a large extent by the engagement of the lock projection 23 with the upper surface of the elastic lock piece 14, the guide surface 135 is not engaged with the elastic lock piece 14. When the female terminal 20 is in an insufficient insertion position relatively distanced from the proper insertion position, the lock projection 23 is engaged with the upper surface of the front end portion of the elastic lock piece 14, causing the elastic lock piece 14 to be elastically deformed and project into the deformation permitting space 15. Accordingly, even if an attempt is made to push the retainer 30 to its full lock position, the deformation preventing portion 32 cannot enter the space 15 because the leading end of the deformation preventing portion 32 abuts against the leading end of the elastic lock piece 14.

On the other hand, if the female terminal 20 is in an insufficient insertion position relatively close to the proper insertion position, a projecting amount of the elastic lock piece 14 into the deformation permitting space 15 is small. Accordingly, if the retainer 30 is pushed to its full lock position in this state, the lock piece guide surface 135 engages the lower edge of the leading end of the elastic lock piece 14 as shown in FIG. 13, and a force pushing the retainer 30 backward is translated by the inclination of the guide surface 135 into a force to push the elastic lock piece 14 upward. When the elastic lock piece 14 is displaced upwardly, a force displacing the elastic lock piece 14 upwardly is translated by the inclination of the terminal guide surface 123B into a force to push the lock projection 23 forwardly. Accordingly, the female terminal 20 is moved from its insufficient insertion position to its proper insertion position. When the female terminal 20 reaches its proper insertion position, the elastic lock piece 14 comes into contact with the lower surface of the female terminal 20 and the retainer 30 slips under the elastic lock piece 14, thereby doubly locking the female terminal 20.

As described above, according to this embodiment, since the female terminal 20 is provided with the terminal guide surface 123B and the retainer 30 is provided with the lock piece guide surface 135, even if there is/are insufficiently inserted female terminal(s) 20 when the retainer 30 is pushed to its fully fitted state or full lock position, such insufficiently inserted female terminal(s) can be pushed to its/their proper insertion position(s). Accordingly, it is not necessary to perform a cumbersome operation of returning the retainer 30 to its partially fitted state or partial lock position, pushing the insufficiently inserted female terminal (s) 20 to its/their proper insertion position(s) and pushing the retainer 30 to its fully fitted state or full lock position again in order to reinsert the female terminal(s) 20.

Figure 14:
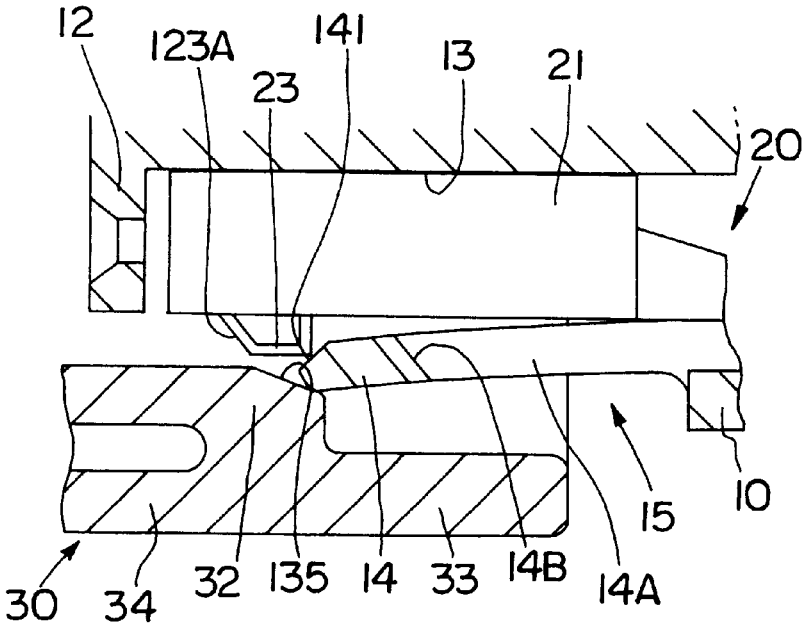
FIG. 14 is an enlarged partial vertical section of a sixth embodiment when a terminal is pushed from an insufficient insertion position to a proper insertion position.

A sixth embodiment of the invention is described with reference to FIG. 14. The sixth embodiment differs from the first embodiment in the construction of the terminal guide surface. Since the other construction is similar or same as that of the first embodiment, no description is given on the same construction, its action and effects by identifying it by the same reference numerals.

Unlike the first embodiment in which the terminal guide surface 23B is formed on the female terminal 20, a terminal guide surface 141 according to the sixth embodiment is formed by cutting off an upper corner of the leading end of the elastic lock piece 14 so as to extend at an angle different from 0° or 180° with respect to the insertion direction A, e.g. obliquely downward to the front. A lock projection 23 according to the sixth embodiment is not formed with the terminal guide surface 23B of the first embodiment or anything corresponding thereto, so that the rear surface thereof extends in a direction substantially perpendicular to insertion and withdrawal directions of the female terminal 20. A right angle corner portion where the rear and lower surfaces of the lock projection 23 intersect engages the terminal guide surface 141.

Figure 15:
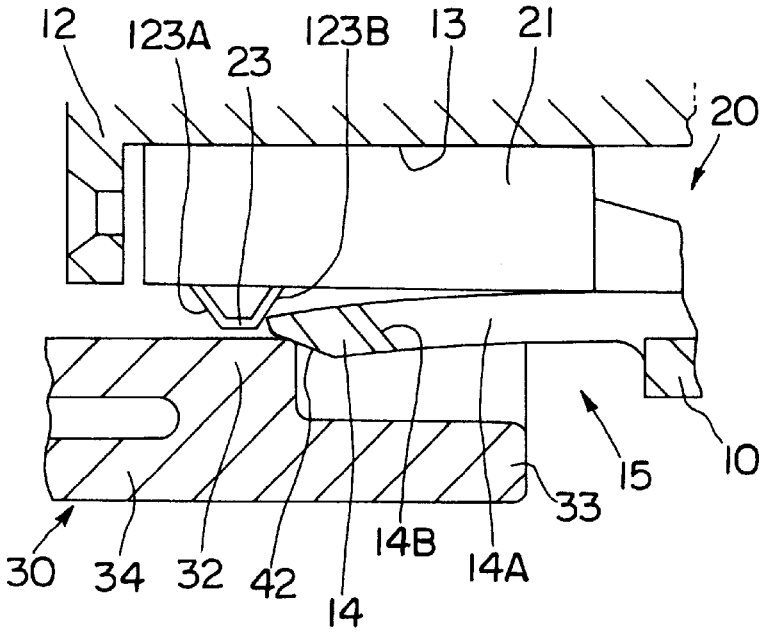
FIG. 15 is an enlarged partial vertical section of a seventh embodiment when a terminal is pushed from an insufficient insertion position to a proper insertion position.

A seventh embodiment of the invention is described with reference to FIG. 15. The seventh embodiment differs from the fifth embodiment in the construction of the lock piece guide surface. Since the other construction is similar or same as that of the fifth embodiment, no description is given on the same construction, its action and effects by identifying it by the same reference numerals.

Unlike the fifth embodiment in which the lock piece guide surface 135 is formed on the retainer 30, a lock piece guide surface 142 according to the seventh embodiment is formed e.g. by cutting off a lower corner of the leading end of the elastic lock piece 14 so as to extend at an angle different from 0°! or 180°, preferably obliquely upward to the front. A retainer 30 according to the seventh embodiment is not formed with the lock piece guide surface 135 of the fifth embodiment or anything corresponding thereto, and the upper surface of the deformation preventing portion 32 of the retainer 30 is a substantially flat surface so that the lower surface of the elastic lock piece 14 can be in contact therewith over an entire area from its front end to its rear end. A substantially right angle corner portion where the upper and rear surfaces of the deformation preventing portion 32 intersect engages the lock piece guide surface 142.

Figure 16:
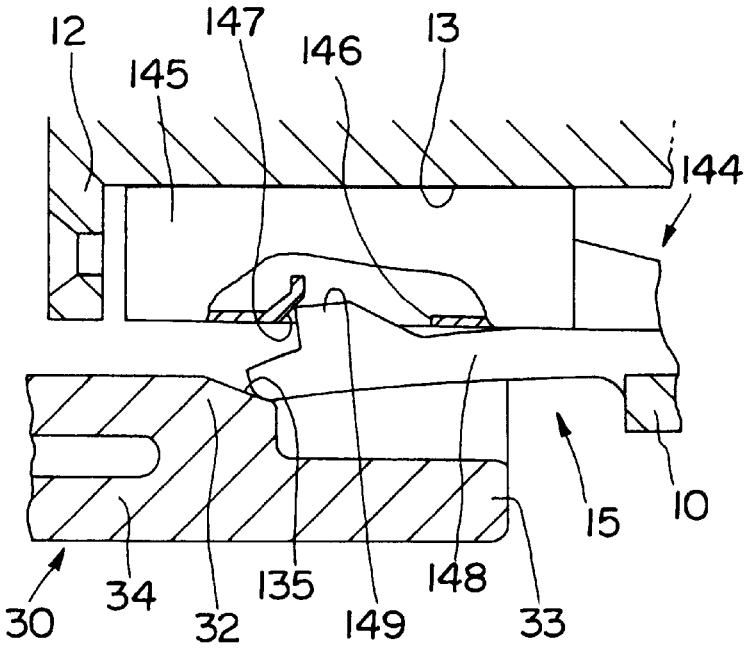
FIG. 16 is an enlarged partial vertical section of a eighth embodiment when a terminal is pushed from an insufficient insertion position to a proper insertion position.
Figure 17:
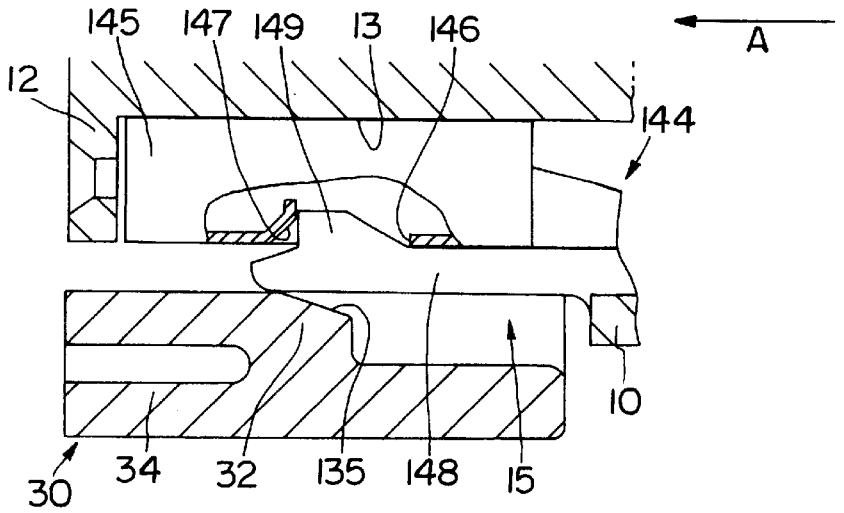
FIG. 17 is an enlarged partial vertical section of the eighth embodiment with the terminal pushed to its proper insertion position.

An eighth embodiment of the invention is described with reference to FIGS. 16 and 17. The eighth embodiment differs from the first embodiment in the construction of the female terminal and the elastic lock piece. Since the other construction is similar or same as that of the first embodiment, no description is given on the same construction, its action and effects by identifying it by the same reference numerals.

A tubular portion 145 of a female terminal 144 according to the eighth embodiment is formed with a lock hole 146 instead of the lock projection 23 of the first embodiment. At the front edge of the lock hole 146 is formed a slanted terminal guide surface 147 which is inclined obliquely upward to the back by bending the bottom plate of the tubular portion 145. On the other hand, an elastic lock piece 148 is formed such that one free end thereof extends in an undeflected state substantially along the insertion direction A of the female terminal 44, e.g. forward while the other end thereof is fixed. An engaging projection 149 projects from the upper surface of a front end portion of the elastic lock piece 148 and is engageable with the lock hole 146. When the retainer 30 is pushed to its fully fitted state full lock position with the female terminal 144 insufficiently inserted, the terminal guide surface 147 of the lock hole 146 and a front end corner portion of the engaging projection 149 of the elastic lock piece 148 are engaged, and the female terminal 20 is pushed to its proper insertion position as shown in FIG. 17 by the inclination of the terminal guide surface 147.

Figure 18:
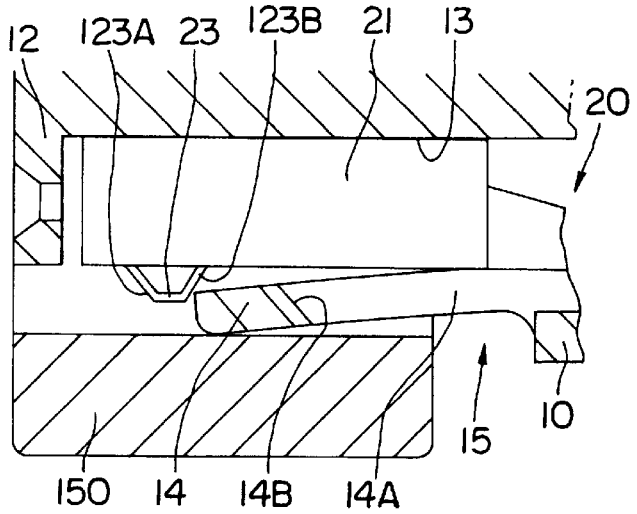
FIG. 18 is an enlarged partial vertical section of a ninth embodiment when a terminal is pushed from an insufficient insertion position to a proper insertion position.
Figure 19:
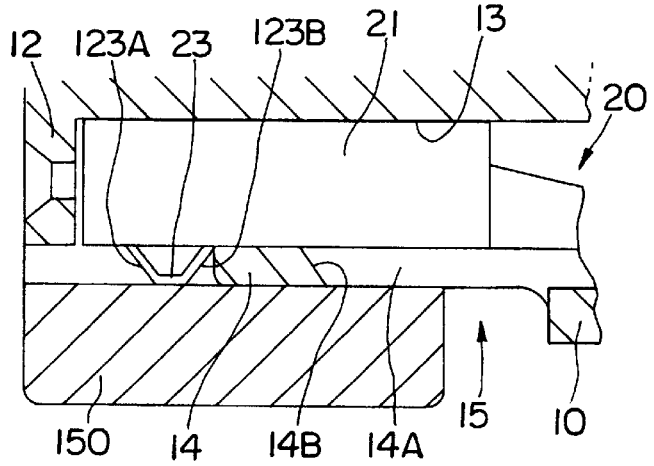
FIG. 19 is an enlarged partial vertical section of the ninth embodiment with the terminal pushed to its proper insertion position.

A ninth embodiment of the invention is described with reference to FIGS. 18 and 19. The ninth embodiment differs from the first embodiment in the construction of the retainer. Since the other construction is similar or same as that of the first embodiment, no description is given on the same construction, its action and effects by identifying it by the same reference numerals.

Unlike the first embodiment in which the retainer 30 is mounted from front with respect to the connector housing 10, a retainer 150 according to the ninth embodiment is mounted laterally with respect to a coupling direction of the connector with a mating connector or with respect to the insertion direction A of the terminal, e.g. from below with respect to the connector housing 10. The retainer 150 is moved at an angle different from 0° or 180° with respect to the insertion direction A, preferably substantially transversely e.g. upward while being displaced from its partially fitted state or partial lock position to its fully fitted state or full lock position. Since a moving direction of the retainer 150 is same as a deformation direction of the elastic lock piece 14, the retainer 150 directly pushes up the elastic lock piece 14 without having its moving direction changed by the inclination. Accordingly, the retainer 150 according to the ninth embodiment is not formed with the lock piece guide surface 35 of the first embodiment or anything corresponding thereto. When the retainer 150 is displaced to its fully fitted state or full lock position with the female terminal 20 insufficiently inserted, the elastic lock piece 14 is pushed up and the female terminal 20 is pushed to its proper insertion position by the inclination of the terminal guide surface 23B as in the first embodiment.

A tenth embodiment of the invention is described with reference to FIGS. 20 to 22. A connector housing according to this embodiment is comprised of a connector housing 10 into which female terminals 20 are inserted, and a retainer 30 to be mounted on the connector housing 10 in order to hold the female terminals 20 in their inserted states.

Each female terminal 20 is comprised of a preferably substantially rectangular, tubular portion 21 and a wire fixing portion 22 which are integrally and continuously formed one after the other. The tubular portion 21 is formed with a lance or engaging portion 223 e.g. by making a cut in its upper wall and bending this cut portion in a first direction, e.g. upward in FIG. 20. The engaging portion 223 extends preferably obliquely backwardly with its front end fixed and its rear end hanging, and is elastically deformable in direction toward and away from the upper surface of the tubular portion 21. The engaging portion 223 is to be locked with a locking portion 214 of a cavity 13 to be described later when the female terminal 20 is properly inserted.

Figure 20:
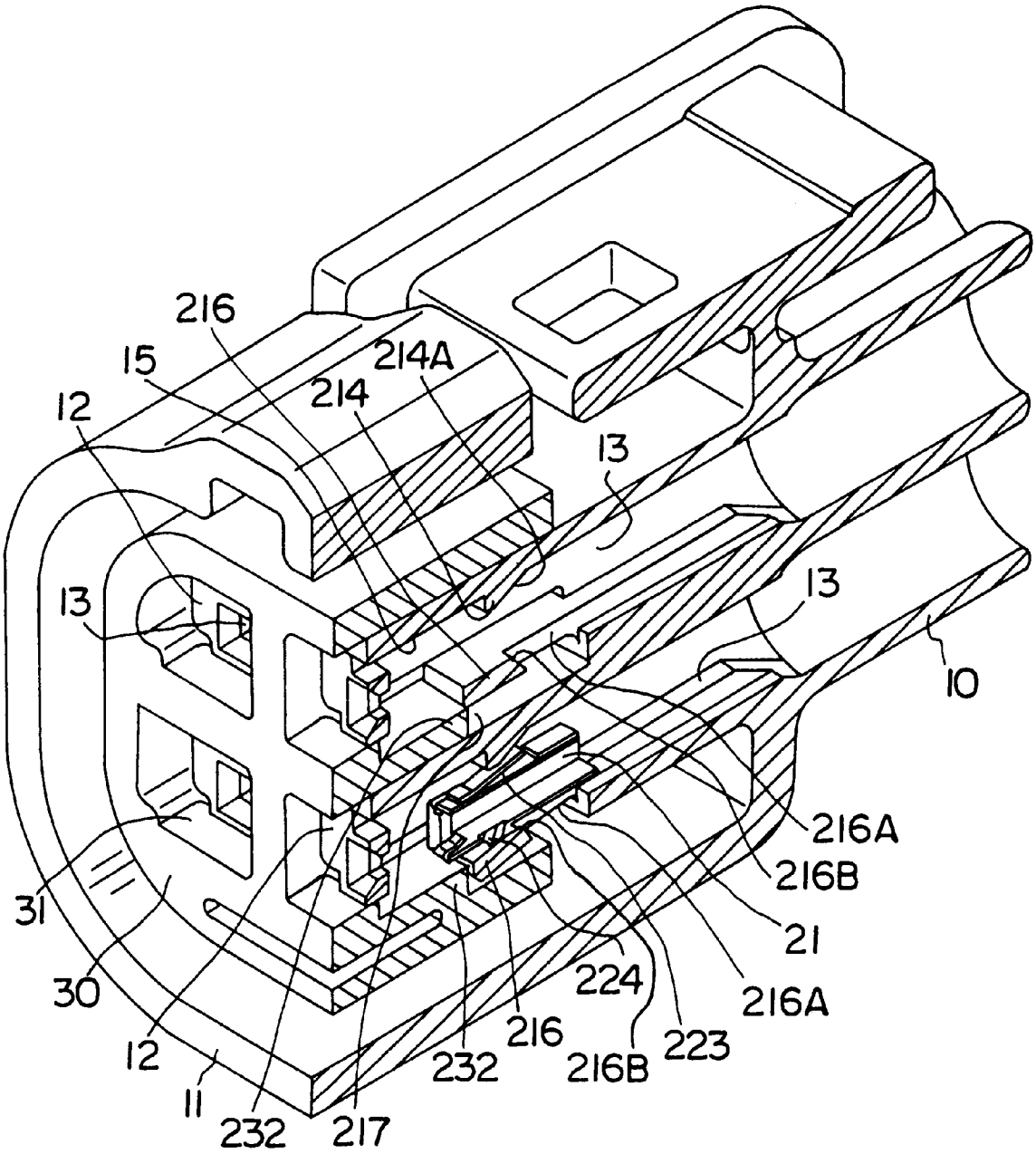
FIG. 20 is a perspective view partly in section of a tenth embodiment of the invention.

On the lower surface of the tubular portion 21 is formed a lock projection (lock portion) 224 which projects in a second direction, preferably substantially opposed to the first direction, e.g. downward in FIG. 20. The lock projection 224 preferably is formed by embossing. This lock projection 224 has a shape of an isosceles trapezoid when viewed sideways. In particular the front surface of the lock projection 224 is a slanted insertion guide surface 224A which is extending at an angle different from 0° or 180° with respect to an insertion direction A (FIG. 22) of the female terminal 20 into the connector housing 10 or with respect to a longitudinal direction of the female terminal 20, in particular obliquely downwardly. The rear surface thereof is a slanted withdrawal guide surface 224B which extends obliquely in the second direction, e.g. downwardly. The thus formed lock projection 224 is locked with an elastic lock piece 216 to be described later when the female terminal 20 is properly inserted.

In the connector housing 10, there preferably are provided a total of four blocks 12. In this embodiment two blocks are provided in each of two rows at upper and lower stages respectively within a hood 11. The female terminals 20 are inserted into cavities 13 formed in the respective blocks 12 through openings at the back of the cavities 13.

From the ceiling surface of each cavity 13, a locking portion 214 projects. The front surface of the locking portion 214 is arranged at an angle different from 0° or 180°, preferably substantially perpendicular to an insertion direction A of the female terminal 20, and the rear surface thereof is a slanted insertion guide surface 214A which is facing e.g. obliquely downwardly. The locking portion 214 and the engaging portion 223 define a first locking means. At an upper part of each cavity 13 is formed a deformation permitting space 15 which extends from the front surface of the locking portion 214 to the front end surface of the connector housing 10. The deformation permitting spaces 15 are preferably formed taking advantage of press work holes of a mold (not shown) for the locking portions 214. The engaging portions 223 are accommodated in the spaces 15 and jigs J to be described later are inserted or insertable into the spaces 15.

An opening is formed in the lower surface of a substantially front end portion of each cavity 13 at the upper stage, i.e. in a partition wall with the lower blocks 12. An opening is also formed in the lower surf ace of a front end portion of each cavity 13 at the lower stage, i.e. in the lower surface of the connector housing. Elastic lock pieces 216 are provided in or at the openings of the respective cavities 13. Each elastic lock piece 216 extends forwardly substantially in parallel with the insertion direction of the female terminal 20 with one end fixed at the rear edge of the opening and the other end hanging or being deformable or displaceable. The elastic lock piece 216 is preferably platelike with its substantially planar surface extending in substantially horizontal direction in the undeformed state, and is elastically deformable in the second direction, e.g. downwardly.

In the middle of the elastic lock piece 216 with respect to its widthwise direction, an escape groove 216A is formed to extend along forward and backward directions in parallel with the insertion direction of the female terminal 20. The escape groove 216A extends from the base end (rear end) of the elastic lock piece 216 to a position thereof immediately behind the front end of the elastic lock piece 216. The lock projection 224 enters the escape groove 216A while the female terminal 20 is being inserted and withdrawn. The lock projection 224 does not interfer the elastic lock piece 216 while being located or inserted in the escape groove 216A. The inner surface of the front end of the escape groove 216A acts as a slanted insertion guide surface 216B which extends or is arranged at an angle different from 0° or 180° with respect to the substantially planar surface of the lock piece 16, and preferably extends obliquely with respect to the first direction, e.g. the upward direction. The front end of the elastic lock piece 216 extends in a direction perpendicular to the insertion direction of the female terminal 20.

As described above, the elastic lock pieces 216 are elastically deformable downwardly, and deformation permitting spaces 217 are provided in the deflection direction of, e.g. below, the respective elastic lock pieces 216. Upon deformation, the elastic lock pieces 216 are slanted with the front ends lowered, thereby projecting into the deformation permitting spaces 217. Deformation preventing portions 232 of the retainer 30 to be described later can also enter the deformation permitting spaces 217.

The retainer 30 is mounted on the connector housing 10 preferably from a direction opposed to the insertion direction A of the female terminal 20, e.g. substantially from the front side, and defines a second locking means together with the lock projections 224, and preferably the withdrawal guide surfaces 224B and the elastic lock pieces 216. Four mount holes 31 which are preferably through holes extending along forward and backward directions are formed in the retainer 30. When the retainer 30 is mounted on the connector housing 10, it covers the outer surface of the connector housing 10 and the blocks 12 are fitted or inserted in the respective mount holes 31. The retainer 30 is selectively held on the connector housing 10 in a partial lock position and a full lock position by an unillustrated locking means. When the retainer 30 is partly locked, the front end surface of the retainer 30 is substantially flush with the front end of the hood 11 (see FIG. 22). When the retainer 30 is fully locked, the front end surface of the retainer 30 is preferably located in a position more toward the inside of the connector housing 10, e.g. backwardly, than the front end surface of the hood 11 (see FIGS. 20 and 21).

The deformation preventing portions 232 are provided in the respective mount holes 31. The deformation preventing portions 232 of the two mount holes 31 at the upper stage are formed by a partition wall partitioning the mount holes 31 at the upper and lower stages, whereas those of the two mount holes 31 at the lower stage are formed by slightly raising the lower surface of the mount holes 31. With the retainer 30 partly locked, the deformation preventing portions 232 are located before the front ends of the elastic lock pieces 216, and the elastic lock pieces 216 are permitted to be elastically deformed into the deformation permitting spaces 217. When the retainer 30 is fully locked, the deformation preventing portions 232 enter the deformation permitting spaces 217, and slip under the elastic lock pieces 216. Thus the elastic deformation of the elastic lock pieces 216 is prevented. While the deformed elastic lock pieces 216 project into the spaces 217, the front ends thereof preferably abut against the deformation preventing portions 232, and a movement of the retainer 30 from its partial lock position to its full lock position is prevented. The deformation preventing surface 232 may have a slanting front surface 232A for avoiding an unwanted interference or interaction with the engaging portion 24 and/or elastic lock piece 226 in its substantially undeflected state.

In assembling the connector according to this embodiment, first, the retainer 30 is partly locked with the connector housing 10 through the opening in the front surface of the hood 11. In this state, the deformation preventing portions 232 are located at a distance spaced, e.g. before, the elastic lock pieces 216 as shown in FIG. 22. Thus the elastic lock pieces 216 are permitted to be elastically deformed to project into the deformation permitting spaces 217.

Next, the female terminals 20 are inserted into the respective cavities 13. When the female terminals 20 approach their proper insertion positions, the engaging portions 223 on their upper surfaces are elastically deformed upon coming into engagement with the locking portions 214, thereby being brought to their deformed state, e.g. to positions substantially flush with the upper surfaces of the tubular portions 21. This allows an insertion of the female connector fitting 20. As a result, the engaging portions 223 slip under the locking portions 214. When the female terminals 20 substantially reach their proper insertion positions, the engaging portion s 223 are elastically restored to their original positions by passing the locking portions 214. Then, as shown at the upper stage of FIG. 22, the engaging portions 223 enter the deformation permitting spaces 15, and their free ends are locked with the front surfaces of the locking portions 214. In this way, the first locking means is locked.

When a force acts on the thus locked female terminal 20 in its withdrawal direction, the engaging portion 223 comes into contact with a portion of the connector housing 10, in particular an angular corner portion thereof, where the front surface of the locking portion 214 and the upper surface of the deformation permitting space 15 intersect, with the result that the female terminal 20 is more securely locked. Accordingly, the locking of the female terminal 20 cannot be released without using the jig J as described later.

Figure 21:
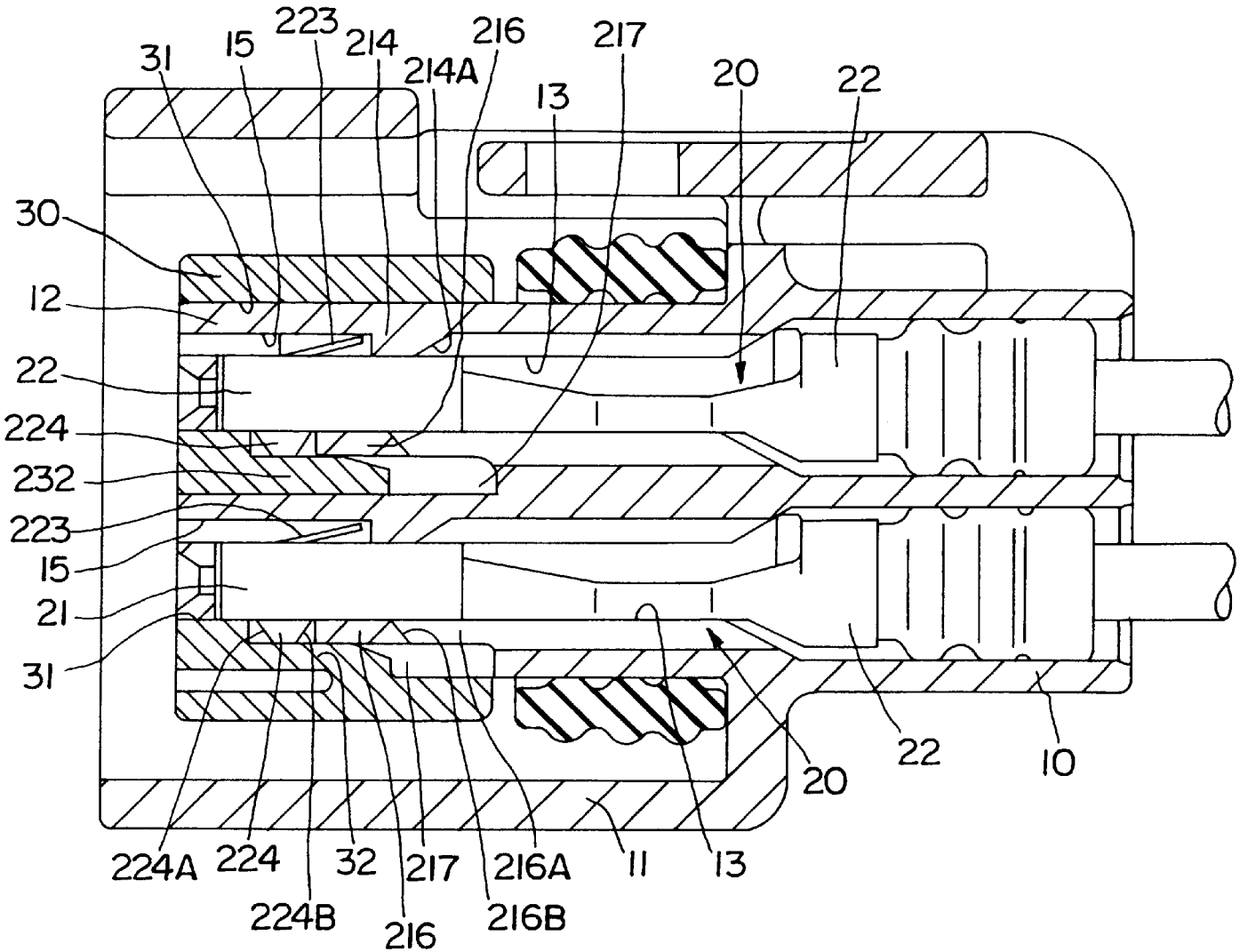
FIG. 21 is a section of the tenth embodiment in which female terminals are doubly locked.
Figure 22:
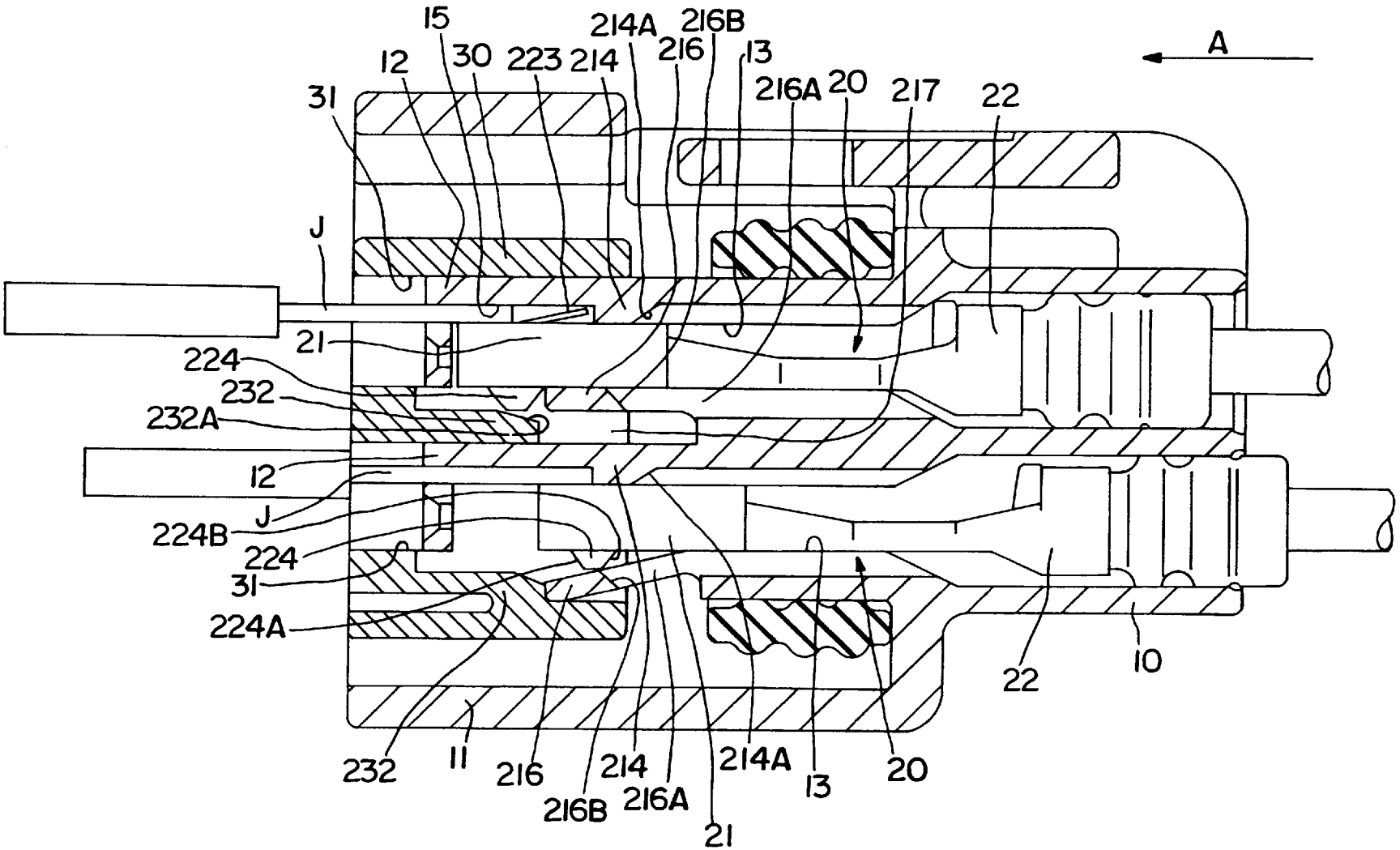
FIG. 22 is a section of the tenth embodiment showing the withdrawal of the female terminals.

On the other hand, at the lower surfaces in FIGS. 21 and 22 of the female terminals 20, the lock projections 224 enter the escape grooves 216A of the elastic lock pieces 216 during the insertion of the female terminals 20. During this time, the elastic lock pieces 216 are substantially not deformed because they are not engaged by the lock projection s 224. When the female terminals 20 approach their proper insertion positions, the insertion guide surfaces 224A of the lock projections 224 come into contact with the insertion guide surfaces 216B at the front ends of the escape grooves 216A, and the elastic lock pieces 216 smoothly undergo an elastic deformation to substantially project into the deformation permitting spaces 217 due to the inclination of the guide surfaces 216B, 224A. As shown at the lower stage of FIG. 22, the lock projections 224 slide along the upper surfaces of the front end portions of the elastic lock pieces 216. When the female terminals 20 reach their proper insertion positions, the lock projections 224 are disengaged from the front ends of the elastic lock pieces 216, and the elastic lock pieces 216 are elastically restored to their original positions, moving out of the spaces 217. As a result, the front end surfaces of the elastic lock pieces 216 come into engagement with the lock projections 224 from a direction substantially opposed to the insertion direction A, e.g. from behind. In this way, the second locking means is primarily locked to define a partially fitted state. Thereafter, when the retainer 30 is pushed from its partial lock position to its full lock position (fully fitted state), the deformation preventing portions 232 slip under the elastic lock pieces 216, thereby preventing the elastic lock pieces 216 from being elastically deformed in such a direction to be disengaged from the lock projections 224. In this way, the second locking means is secondarily locked to define the fully fitted state.

When a force acts on the thus locked female terminal 20 in its withdrawal direction, the elastic lock piece 216 is pressed by the withdrawal guide surface 224B of the lock projection 224 in such a direction to be disengaged from the lock projection 224. However, since the deformation of the elastic lock piece 216 is hindered or prevented by the deformation preventing portion 232 of the retainer 30, the primary locking of the lock projection 224 and the elastic lock piece 216 is not released.

As described above, the female terminals 20 are doubly locked with high reliability by the first locking means on their upper surfaces and the second locking means (preferably in its fully fitted state) on their lower surfaces and, specifically, are securely held in their proper insertion positions while their movement in their withdrawal direction is prevented.

In the case that not all female terminals 20 have reached their proper insertion positions, i.e. there is/are insufficiently inserted female terminal(s) 20, the lock projection 224 is engaged with the upper surface of the front end portion of the elastic lock piece 216, causing the elastic lock piece 216 to be elastically deformed and to project into the deformation permitting space 217 as shown at the lower stage of FIG. 22. Accordingly, even if an attempt is made to push the retainer 30 to its fully fitted state or full lock position, it cannot be done because the leading end of the deformation preventing portion 232 abuts against the leading end of the elastic lock piece 216.

Specifically, if all female terminals 20 are properly inserted, the retainer 30 can be pushed to its fully fitted state, in particular to its full lock position. On the other hand, if there is/are insufficiently inserted female terminal(s) 20, the retainer 30 cannot be pushed to its fully fitted state, in particular full lock position. Accordingly, the insufficient insertion of the female terminal(s) 20 can b e detected based on whether or not the retainer 30 can be pushed to its fully fitted state, in particular full lock position or not.

In order to withdraw the female terminals 20 doubly locked by the first and second locking means, both locking means should be simultaneously unlocked. This embodiment is designed to improve an operability of this withdrawal. Hereafter, a procedure of the withdrawal is described with reference to FIG. 22.

First, the retainer 30 as the second locking means is shifted from its fully fitted state to its partially fitted state, in particular is pulled back from its full lock position to its partial lock position. Then, the deformation preventing portions 232 are disengaged from the elastic lock pieces 216, thereby releasing the secondary locking, with the result that the elastic lock pieces 216 are permitted to be elastically deformed and to project into the deformation permitting spaces 217. In this way, a preparation of the at least partial withdrawal in the second locking means is completed.

Next, the first locking means is unlocked. This is done by inserting or fitting the narrow jigs J into the deformation permitting spaces 15, in which the engaging portions 223 are accommodated, from the front side of the connector housing 10 and pressing the engaging portions 223 by these jigs J to bring them to their positions in flush with the upper surfaces of the corresponding female terminals 20. In this way, the first locking means is unlocked. The jigs J are left in the spaces 15 to keep the unlocked state.

In this state, the female terminals 20 are pulled backward. Then, the engaging portions 223 pressed by the jigs J smoothly slip under the locking portions 214 and pass them. Since the engaging portions 223 slip under the locking portions 214 preferably substantially immediately after the start of the movement of the female terminals 20, the jigs J may be detached after the female terminals 20 are slightly moved backward.

On the other hand, in the second locking means, the withdrawal guide surfaces 224B of the lock projections 224 come into engagement with the front edges of the elastic lock pieces 216, which are guided downwardly by the inclination of the guide surfaces 224B, thereby smoothly undergoing an elastic deformation. Then, the elastic lock pieces 216 are disengaged from the lock projections 224, releasing the primary locking by the second locking means. After the lock projections 224 slide along the upper surfaces of the front end portions of the elastic lock pieces 216, the elastic lock pieces 216 are elastically restored to their original positions and the lock projections 224 substantially enter the escape grooves 216A and move without interfering the elastic lock pieces 216. Finally, the female terminals 20 are withdrawn from the cavities 13.

As described above, in this embodiment, whether or not all female terminals 20 are properly inserted and whether or not there is/are insufficiently inserted female terminal(s) 20 can be discriminated based on whether or not the retainer 30 can be pushed to its fully fitted state, in particular full lock position. Further, the female terminals 20 can be doubly locked by the first and second locking means provided in different positions of the female terminals 20. In other words, this embodiment has a more reliable function of holding the female terminals 20 in their properly inserted states as well as a function of detecting the insufficient insertion of the female terminals 20.

Further, in this embodiment, the double locking of the female terminals 20 is released as follows. The second locking means is unlocked by moving the retainer 30 to its partial lock position before the female terminals 20 are withdrawn. The first locking means is unlocked by inserting the jigs J simultaneously the withdrawal of the female terminals 20. Since the retainer 30 needs not be moved simultaneously with the withdrawal of the female terminals 20, the unlocking operation can be easily and securely performed. On the other hand, although the jigs J need to be operated simultaneously with the withdrawal of the female terminals 20, since the jigs J need to be operated only for the first locking means, the unlocking operation can be more easily and securely performed as compared to the case where both first and second locking means are unlocked using jigs. In other words, the connector according to this embodiment has an excellent operability in the withdrawal of the female terminals 20. Moreover, the operability in the withdrawal of the female terminals 20 is not improved at the expense of the locking function and, thus, a highly reliable double locking function is realized as mentioned above.

Figure 23:
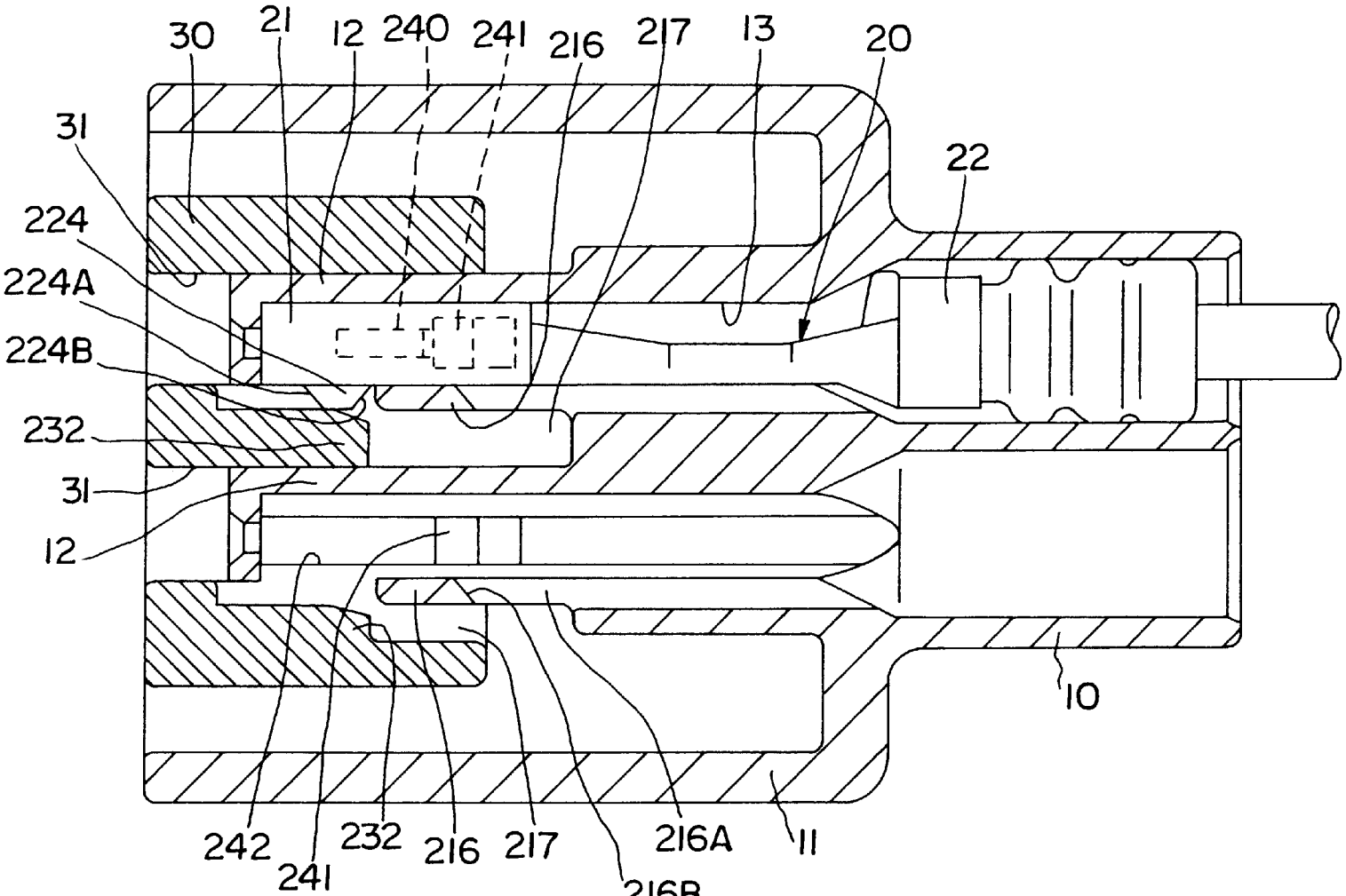
FIG. 23 is a section of a eleventh embodiment in which female terminals are properly inserted and a retainer is partly locked.
Figure 24:
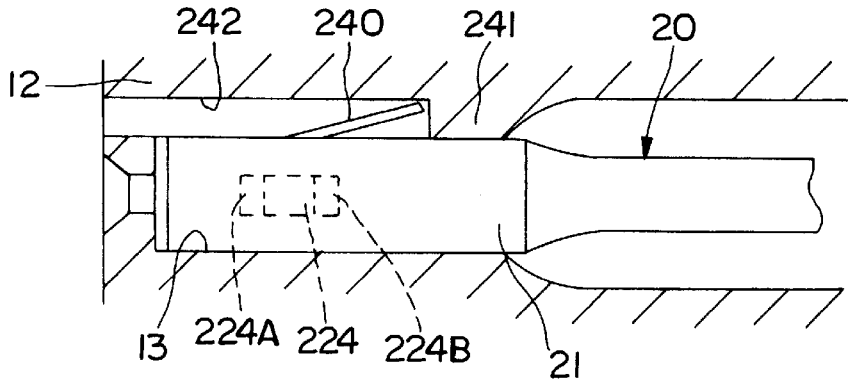
FIG. 24 is a horizontal section of the eleventh embodiment in which the female terminals are locked by a first locking means.
Figure 25:
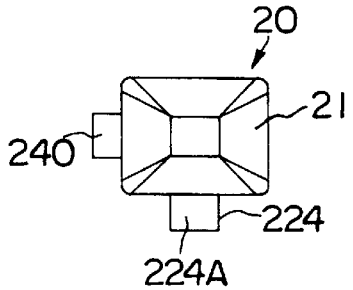
FIG. 25 is a front view of the female terminal according to the eleventh embodiment.
Figure 26:
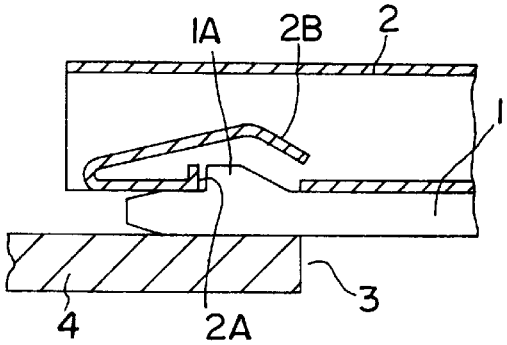
FIG. 26 PRIOR ART
FIG. 26 is a partial section of a prior connector.
Figure 27:
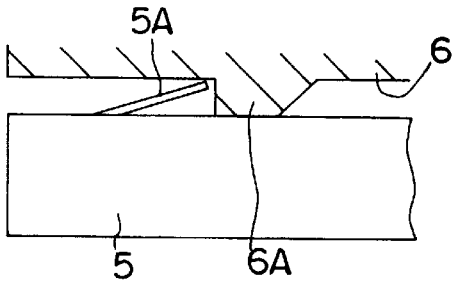
FIG. 27 PRIOR ART
FIG. 27 is a partial section of another prior art connector.

An eleventh embodiment of the invention is described with reference to FIGS. 23 to 25. This embodiment differs from the tenth embodiment in the arrangement of the first locking means. Since the other construction is similar or same as that of the tenth embodiment, no description is given on the similar or same construction as well as its action and effects by identifying it by the same reference numerals.

Unlike the first locking means of the tenth embodiment which is provided on the upper surface of the female terminal 20, a first locking means of the eleventh embodiment is provided on a surface arranged at an angle different from 0° or 180° with respect to the surface on which the first locking means is provided, preferably substantially normal thereto, e.g. On a lateral or left side surface of the female terminal 20 when viewed from front. Specifically, this first locking means is constructed by a lance or engaging portion 240 of the female terminal 20 formed by making a cut in a lateral, e.g. left side wall and bending this cut portion obliquely backward, and a locking portion 241 and a deformation permitting space 242 formed on a lateral, e.g. left side wall surface of the cavity 13 of the connector housing 10. As shown in FIG. 25, such a first locking means and the second locking means are arranged on two outer surfaces (a left side surface and a bottom surface) of the female terminal 20 which are arranged at an angle different from 0° or 180°, preferably substantially perpendicular to each other when viewed from front. The ceiling surface of the cavity 13 comes into close contact with the upper surface of the female terminal 20, and the right side wall surface thereof comes into close contact with the right side surface of the female terminal 20. Since the insertion of the female terminal 20, the double locking function and the withdrawal of the female terminal 20 are same as those of the tenth embodiment, no description is given thereon.

Since the first and second locking means are arranged on the surfaces perpendicular to each other in the eleventh embodiment, even if the outer surface of the female terminal 20 is displaced toward or away from the inner surface of the cavity 13 at one locking means, the outer surface of the female terminal 20 is substantially not displaced toward or away from the inner surface of the cavity 13 at the other locking means.

For example, even if the locked state of the engaging portion 240 and the locking portion 241 changes at the first locking means due to the left side surface of the female terminal 20 moving toward or away from the inner surface of the cavity 13, the lock projection 224 and the elastic lock piece 216 are only displaced in substantially horizontal direction (direction substantially perpendicular to the surface of FIG. 25) and, accordingly, the locked state thereof does not change. Similarly, a change in the locked state of the second locking means does not influence the locked state of the first locking means. Therefore, the reliability of the double locking function is further improved.

Further, in the eleventh embodiment, at the sides opposite to both locking means, the outer surface of the female terminal 20 is in close contact with the inner surface of the cavity 13. Accordingly, in the first locking means, a displacement of the engaging portion 240 in such a direction to be disengaged from the locking portion 241 is prevented and, in the second locking means, a displacement of the elastic lock piece 216 in such a direction to be disengaged from the lock projection 224 is prevented. In other words, the locked state is not loosened irrespective of how the female terminal 20 is displaced. In this respect as well, the reliability of the locking function is improved.

The present invention is not limited to the described and illustrated embodiments. For example, the following embodiments are embraced by the technical scope of the present invention as defined in the claims. Besides the following embodiments, a variety of changes can be made without departing the spirit and scope of the present invention as defined in the claims.

Although the female connector housing into which the female terminals are inserted is described in the foregoing embodiments, the invention is also applicable to a male connector into which male terminals are inserted.

Although the withdrawal guide surfaces are provided in the foregoing embodiments, the invention is also applicable to a construction which is not provided with the withdrawal guide surfaces. In such a case, the elastic lock pieces may be disengaged from the lock projections using jigs.

Although the elastic lock pieces are formed with the escape grooves in the foregoing embodiments, they may not be provided with the escape grooves according to the invention.

Although the width of the elastic lock pieces is set larger than that of the female terminals in the foregoing embodiment, it may be equal to or smaller than the width of the female terminals.

In the foregoing embodiments, the escape groove is so formed as to extend along the widthwise center of the elastic lock piece and the lock projection is movable along this escape groove. However, according to the invention, there may be provided a pair of lock projections and a pair of recesses preferably formed along the opposite side edges of the elastic lock piece, such that the pair of lock projections move in the pair of recesses.

Although the slanted guide surface is formed on either the elastic lock piece or the lock projection in the first to seventh embodiments, it may be formed on both the elastic lock piece and the lock projection according to the invention.

Although the slanted guide surface is formed on either the elastic lock piece or the retainer in the first to seventh embodiments, it may be formed on both the elastic lock piece and the retainer according to the invention.

Although the slanted guide surface is formed only on the latter of the elastic lock piece and the lock hole in the eighth embodiment, it may be formed only on the elastic lock piece or on both the lock hole and the elastic lock piece according to the invention.

Although the slanted guide surface is formed only on the latter of the elastic lock piece and the retainer in the eighth embodiment, it may be formed only on the elastic lock piece or on both the elastic lock piece and retainer according to the invention.

Although the slanted guide surface is formed only on the former of the lock projection and the elastic lock piece in the ninth embodiment, it may be formed only on the elastic lock piece or on both the elastic lock piece and the lock projection according to the invention.

The construction of the ninth embodiment in which the retainer pushes the elastic lock piece from below (in a direction substantially transverse to insertion and withdrawal directions of the terminal) may also be applied to a connector of the type in which the elastic lock piece and the lock hole are engaged with each other.

According to the invention, the second locking means may be such that a projection provided on the elastic lock piece is fitted into a lock hole (lock portion) formed in the terminal.

According to the invention, the first locking means may be such that the elastic lock piece provided in the connector housing is engaged with a lock hole formed in the terminal or with a lock projection provided on the terminal. In such cases, the elastic lock piece, the lock hole or the lock projection are shaped such that the elastic lock piece cannot be disengaged from the lock hole or lock projection only by pulling the terminal, but can be disengaged therefrom by being deformed by a jig or the like disengagement means (e.g. a tip or blade of a screw driver).

Although the guide surface (guide portion) of the second locking means is formed on the lock portion of the terminal in the foregoing embodiment, the elastic lock piece may be provided with the guide portion.

What is claimed is:

1. A connector, comprising:

a connector housing having at least one cavity and at least one deformation permitting space in proximity to said cavity, at least one terminal insertable into the cavity of the connector housing into a properly inserted position, the terminal having an outer surface and a lock projection projecting outwardly from said surface and toward said deformation permitting space, at least one elastic lock piece provided on the connector housing adjacent the cavity so as to be engageable with the lock projection of the terminal such that the lock projection deflects the elastic lock piece into the deformation permitting space prior to the terminal reaching the properly inserted position, said elastic lock piece being configured to resiliently return to an undeflected condition between said cavity and said deformation permitting space when said terminal is in said properly inserted position, and a retainer mountable with the connector housing so as to be engageable with the elastic lock piece, the elastic lock piece being held engaged with the terminal when the terminal is in the properly inserted position and when the retainer is mounted in a holding position.

2. A connector according to claim 1, wherein at least one of the lock projection and the elastic lock piece is formed with a tapered slanted guide surface for guiding the elastic displacement of the elastic lock piece in a direction toward the deformation permitting space during the insertion of the terminal.

3. A connector according to claim 1, wherein the retainer comprises a deformation preventing portion which prevents the elastic displacement of the elastic lock piece by entering the deformation permitting space into which the elastic lock piece is deflectable, and the deformation preventing portion being hindered from entering the deformation permitting space by coming into contact with the elastically displaced elastic lock piece when the terminal is not in the properly inserted position.

4. A connector according to claim 1, wherein at least one of the lock projection and the elastic lock piece is formed with a slanted guide surface for guiding the elastic displacement of the elastic lock piece in a direction toward the deformation permitting space during withdrawal of the terminal.

5. A connector according to claim 1, wherein the elastic lock piece has one end thereof fixed and another end thereof being deflectable and substantially extending along an insertion direction (A) of the terminal in an undeformed state, the lock projection of the properly inserted terminal is lockable with the deflectable end of the elastic lock piece.

6. A connector according to claim 1, wherein an escape portion is formed in an area of the elastic lock piece except its deflectable end so that the lock projection and the elastic lock piece do not interfere with each other during a major portion of the insertion of the terminal.

7. A connector according to claim 6, wherein the escape portion is an elongate recess disposed between opposed longitudinal sides of the elastic lock piece and between opposed ends thereof, the recess being dimensioned to receive the lock projection of the terminal.

8. A connector according to claim 7, wherein the recess defining the escape portion extends entirely through the elastic lock piece.

9. A connector according to claim 1, wherein the width of the elastic lock piece is substantially larger than that of the terminal.

10. A connector according to claim 1, wherein the retainer is provided with an excessive deformation preventing portion adjacent the deformation permitting space for preventing the elastic lock piece from being elastically deformed to a larger extent than specified, when the retainer is in a partially fitted state position.

11. A connector according to claim 1, wherein at least one of the terminal and an engaging portion of the elastic lock piece is formed with a slanted terminal guide surface for pushing the terminal in an insufficiently inserted position to its properly inserted position as the elastic lock piece is deformed according to the displacement of the retainer to its holding position.

12. A connector according to claim 1, wherein a displacement direction of the retainer to its holding position is substantially parallel with an insertion direction (A) of the terminal and wherein at least either one of the retainer and an engaging portion of the elastic lock piece is formed with a slanted lock piece guide surface for causing the deformation of the elastic lock piece in such a direction to push the terminal in the insufficiently inserted position to its properly inserted position as the retainer is displaced to its holding position.

13. A connector according to claim 1, further comprising: additional locking means for holding the terminal in its properly inserted position.

14. A connector according to claim 13, wherein the terminal has two outer surfaces which are arranged substantially perpendicular to each other, and the holding means and the additional locking means are arranged on one and the other of the two outer surfaces, respectively.

* * * * *